US007131237B2

(12) United States Patent
Pazar

(10) Patent No.: US 7,131,237 B2
(45) Date of Patent: Nov. 7, 2006

(54) RECORD RECEPTACLE FOR A BURIAL VAULT

(75) Inventor: Michael S. Pazar, Villa Park, IL (US)

(73) Assignee: Wilbert Funeral Services, Inc., Broadview, IL (US)

( * ) Notice: Subject to any disclaimer, the term of this patent is extended or adjusted under 35 U.S.C. 154(b) by 136 days.

(21) Appl. No.: 10/633,056

(22) Filed: Jul. 31, 2003

(65) Prior Publication Data

US 2004/0020139 A1 Feb. 5, 2004

Related U.S. Application Data

(62) Division of application No. 10/093,583, filed on Mar. 8, 2002.

(51) Int. Cl.
*E04H 13/00* (2006.01)

(52) U.S. Cl. ..... 52/138; 52/103; 52/136

(58) Field of Classification Search ..... 27/1, 27/2, 8, 14, 16, 19, 35, DIG. 1, 10; 47/41.1, 47/41.14; 40/124 J, 493, 497, 506; 52/103, 52/105, 134–136, 138; 248/128; 211/85.27; 22/4.27, 3.4, 3.5

See application file for complete search history.

(56) References Cited

U.S. PATENT DOCUMENTS

| | | | | |
|---|---|---|---|---|
| 291,106 | A | | 1/1884 | Strong |
| 669,412 | A | | 3/1901 | Harriman |
| 682,950 | A | | 9/1901 | McNeal |
| 754,269 | A | | 3/1904 | Witt et al. |
| 2,075,859 | A | * | 4/1937 | Martin ..... 52/38 |
| 2,336,003 | A | | 12/1943 | Fifer |
| 3,435,494 | A | * | 4/1969 | Julien ..... 27/11 |
| 3,439,461 | A | | 4/1969 | Chandler et al. |
| 3,839,768 | A | | 10/1974 | McQuestions |
| 4,060,581 | A | | 11/1977 | Darby et al. |
| 4,328,606 | A | * | 5/1982 | Nunes ..... 27/35 |
| 4,697,316 | A | * | 10/1987 | Semon ..... 27/1 |
| 5,088,167 | A | * | 2/1992 | Rahe ..... 27/1 |
| 5,157,888 | A | | 10/1992 | Lindquist |
| 5,675,876 | A | * | 10/1997 | Benedict et al. ..... 27/2 |
| 5,727,291 | A | * | 3/1998 | Biondo et al. ..... 27/2 |
| 5,875,529 | A | * | 3/1999 | Ollier ..... 27/6 |
| 5,960,524 | A | | 10/1999 | Darby et al. |
| 6,088,955 | A | * | 7/2000 | Nelson et al. ..... 47/41.1 |
| 6,088,973 | A | * | 7/2000 | Weiss ..... 52/105 |
| 6,279,212 | B1 | * | 8/2001 | Balch ..... 27/1 |
| 6,282,763 | B1 | | 9/2001 | Goria |
| 6,363,635 | B1 | * | 4/2002 | England ..... 40/124.5 |
| 6,463,703 | B1 | * | 10/2002 | Mattis ..... 52/103 |
| 6,754,940 | B1 | * | 6/2004 | Boots ..... 27/27 |
| 6,904,721 | B1 | * | 6/2005 | Forbes ..... 52/103 |

* cited by examiner

*Primary Examiner*—Carl D. Friedman
*Assistant Examiner*—Yvonne M. Horton
(74) *Attorney, Agent, or Firm*—Brinks Hofer Gilson & Lione

(57) ABSTRACT

A metallic receptacle is embedded in the concrete material of a burial vault. The receptacle contains archival quality paper that records information identifying the person interred in the burial vault and the precise location at which the vault was buried. The receptacle is sealed by a cap that may be removed to access the archival information without opening the vault.

26 Claims, 18 Drawing Sheets

3200

3110 Name of Deceased _____

3112 Date of Birth _____

3114 Date of Death _____

3116 County and State of Death _____

CEMETERY INFORMATION

3118 Place of Interment (Cemetery) _____

3210 County of Interment _____

3212 Cemetery Lot Information

3214 Section _____ Lot # _____ 3216

3218 Row _____ Grave # _____ 3220

FUNERAL HOME INFORMATION

3230 Funeral Home _____

3232 City _____

3234 State _____

VAULT MANUFACTURING COMPANY

3240 _____

3242 City _____

3244 State _____

3250 *When opening any burial vault after interment, in addition to appropriate respect, full health care precautions should be taken at all times.*

FIG. 31

3260

A PERSONAL MESSAGE

Wilbert

3200

Memorial Scroll

Name of Deceased

Date of Birth

Date of Death

County of Death

State of Death

CEMETERY INFORMATION

Place of Interment
(Cemetery Name)

County of Interment

Cemetery Lot:

Section _____ Lot # _____

Row _____ Grave # _____

FUNERAL HOME INFORMATION

Funeral Home

City

State

Wilbert

Locally Manufactured
By:

Wilbert Manufacturer

City State

*When opening any burial vault after interment, in addition to appropriate respect, full health care precautions should be taken at all times.*

FIG. 32

RECORD RECEPTACLE FOR A BURIAL VAULT

RELATED APPLICATION

This application is a division of U.S. patent application Ser. No. 10/093,583, filed Mar. 8, 2002, entitled "Record Receptacle for a Burial Vault, "(pending) which is hereby incorporated by reference herein.

FIELD OF THE INVENTION

The invention relates generally to the embedding of materials in concrete or a like durable material, and more particularly to embedding a record receptacle in a burial vault.

BACKGROUND

Historically, floods have been known to carry away burial vaults. When floodwaters recede, burial vaults have been found far away from cemetery grounds, sometimes miles from the original burial site. It has heretofore been necessary to open such displaced vaults and attempt to identify the remains of the deceased and determine the exact location from which the vault was moved. Even if a burial vault is not moved, it is possible that burial records identifying the deceased could be lost over time, thus making it necessary to access the remains within the vault in order to attempt to identify the deceased.

Currently, it is difficult, if not impossible, to identify human remains and locate the precise place of interment. While DNA or dental records may be used for the purpose of identification, these methods can be time consuming and costly. Also, dental records and DNA samples may not be available to match the remains and it may therefore not be possible to identify the deceased.

Although some caskets or burial vaults contain exterior nameplates that identify the deceased, these nameplates do not provide complete identifying information, tend to decompose as a result of long exposure underground, and can become illegible over time. It would therefore be desirable to develop a reliable method for fully identifying the deceased contained within a burial vault and the precise burial location of the vault, without having to open the vault and examine its contents.

Information sheets have been disposed in some caskets to identify the deceased and the cemetery in notes made on the sheets. Some such caskets may be placed in a vault that is then buried and some such caskets may themselves be buried.

The known information materials are either placed directly into the casket or in a steel tube that is inserted into or affixed to the casket. For example, The Batesville Casket Company drills a recess into a casket and welds a steel tube within the recess. A scroll of paper is inserted into the tube to identify the deceased and cemetery. While these information materials are impressive and comforting at the time of interment, they may not provide a record that is relatively impervious to the elements and the passage of time. A steel tube deteriorates due to corrosion over time and the enclosed information materials may also be subject to relatively rapid deterioration.

A problem also occurs in that, compared to a vault, caskets deteriorate relatively quickly. Likewise, information materials contained within caskets may deteriorate relatively rapidly in response to deterioration of the casket. Also, the information provided by such materials may not be sufficiently precise to record the exact burial location of the casket, fully identify the deceased and provide a personal record concerning the deceased. And if any such casket is placed within a burial vault, the vault must be opened in order to access the information contained within the casket.

Thus, there is a need to provide a system, method and apparatus with archival quality records that can be easily accessed from outside a burial vault to fully identify the deceased, the exact location of his interment and perhaps even the nature of his personality and interests a century or more after burial.

BRIEF SUMMARY

The method, system and apparatus of the preferred embodiments of the invention can identify a deceased interred within a vault and the precise location at which the vault was buried. This information is provided by archival quality materials that resist wear by the elements and are reliably and easily accessed a century or more after burial without opening the vault. A burial vault can therefore be restored to its original location without disturbing the remains within the vault.

In one form, a record receptacle is embedded within the top or side wall of a burial vault. The embedded receptacle has an exposed end that is easily accessed from outside the vault to retrieve an archival record stored therein. The receptacle holds archival grade media that are used to identify the deceased interred in the vault and the burial location, as well as provide personal information concerning the deceased. These media are sealed within the receptacle against moisture or other contaminants and can therefore provide legible information a century or more after interment, without opening the vault or disturbing its contents.

The receptacle may be cylindrical in shape and made of a metal, such as brass, or a non-metal, such as plastic, that will not deteriorate over time and that will withstand the elements. The receptacle has a cap that fits over an exposed open end of its body, which is held in place within the wall of the vault by grooves disposed in its outer surface. An epoxy adhesive adheres the receptacle within the wall and prevents cracks at the interface of the wall and receptacle. The cap is attached to and sealed against the body by screw threads and an elastomeric seal.

The record receptacle can be applied to different types of vaults by means of special manufacturing instructions and a retrofit kit of materials that are used to embed the record receptacle when the vault is made. Manufacturers implement such retrofits under license. Further aspects and advantages of the invention are discussed below with reference to the drawings.

BRIEF DESCRIPTION OF THE DRAWINGS

FIG. 31 shows another embodiment of the record media.

FIG. 32 shows exemplary record media with personal information.

DETAILED DESCRIPTION

Figure 1:
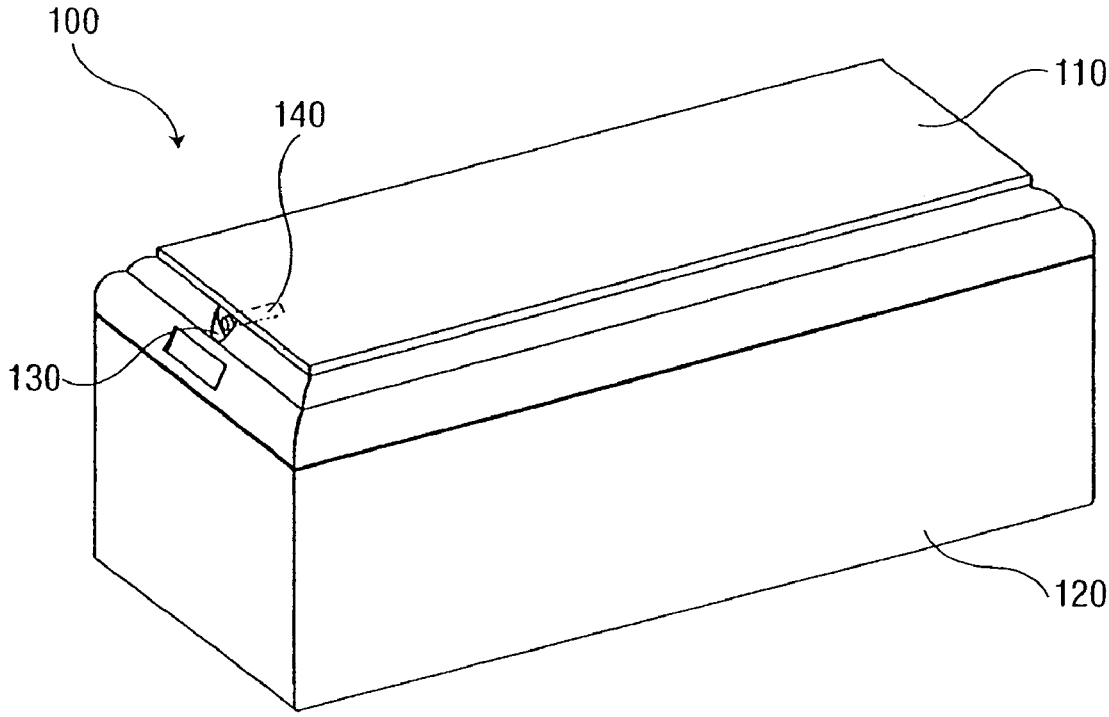
FIG. 1 is a perspective view of a burial vault with an embedded record receptacle.

FIG. 1 illustrates a perspective view of a burial vault 100 for use with an embedded and sealed record receptacle 140 according to a preferred embodiment. Burial vaults 100 typically hold a casket (not shown) that in turn contains the remains of a deceased human or other organic creature. The record receptacle 140 may be cylindrical in shape and contains one or more paper scrolls or other record media (not shown in FIG. 1) having information concerning the deceased and the burial location of the vault 100, printed or stored in an archival quality form and hermetically sealed within the receptacle 140. The vault 100 includes a lid 110 and a base 120 which may be made of concrete, plastic or other durable material able to withstand the pressure of soil and water when interred in the ground for a century or more. The lid 110 rests in pressure sealed relation on the base 120 to enclose a casket within the vault 100. The vault 100 is typically ceremoniously buried in the ground after the casket is enclosed in the vault.

Figure 2:
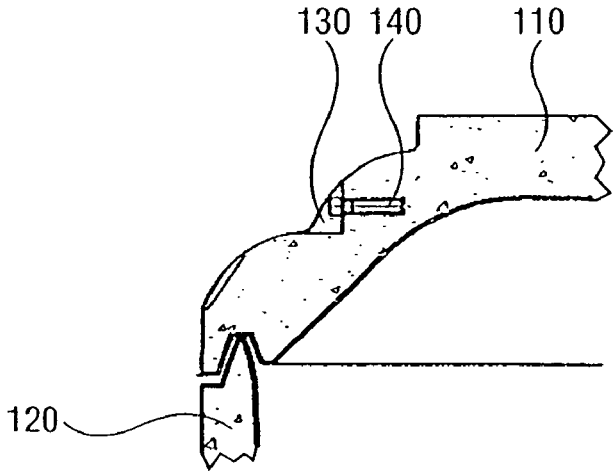
FIG. 2 is a side cutaway view of a burial vault with the embedded record receptacle.

FIG. 2 illustrates a cutaway side view of a concrete vault 100 and an embedded record receptacle 140. In one embodiment the record receptacle 140 is cast and embedded horizontally in the lid 110 so that the receptacle 140 is positioned substantially parallel with the base 120 of the vault. The receptacle 140 may be disposed in other positions, however, such as generally perpendicular to the base 120, as discussed in detail below. A method for casting and embedding the record receptacle 140 in the vault 120 is also discussed below.

Figure 3:
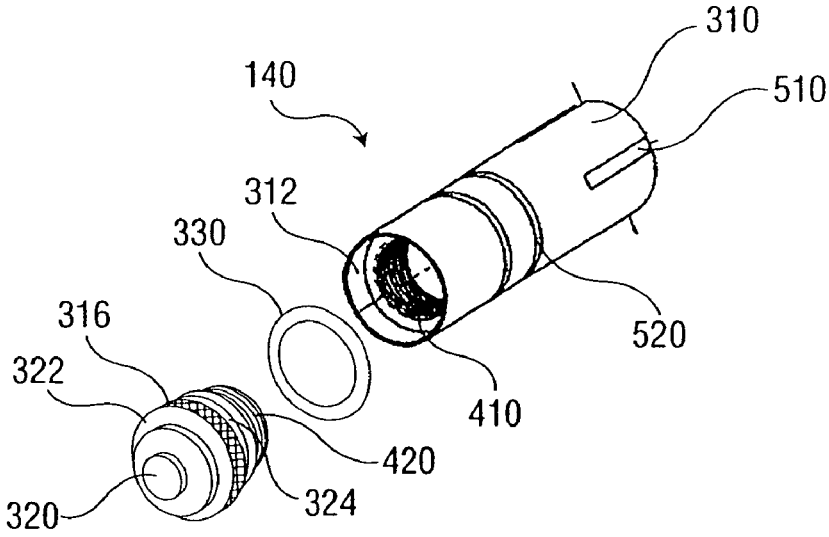
FIG. 3 illustrates an exploded perspective view of the body of an embodiment of the receptacle showing an open end with threads, a sealing agent, and a cap with threads.
Figure 4:
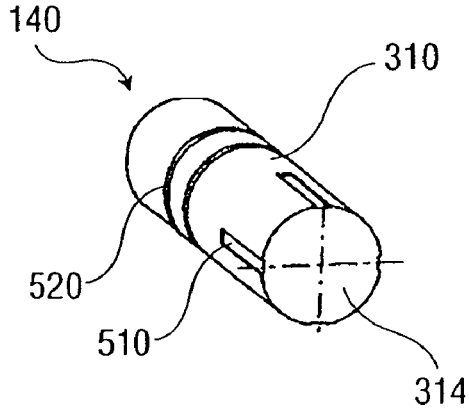
FIG. 4 is a perspective view of the body of the receptacle showing a closed end opposite the open end.

FIGS. 3 and 4 illustrate a perspective view of an embodiment of the record receptacle 140. The receptacle 140 may be made of metal, for example brass, and may be cylindrical in shape, with a hollow body 310, a cap 320, and a sealing agent 330 such as an O-ring that may be made of nylon, neoprene or a durable elastomeric material. While any O-ring that aids in the creation of a hermetic and/or watertight seal will suffice, the O-ring is preferably a fluroelastomer such as VITON manufactured by the Dupont Company, headquartered in Wilmington, Del. or FLUOREL or AFLOS manufactured by the 3M Company, headquartered in St. Paul, Minn. However, other sealing agents are available. For example, the sealing agent 330 could be implemented by a gasket, a washer, putty, a sealing tape such as TEFLON tape or even solder.

The purpose of the sealing agent 330 is to aid in the creation of a seal between the body 310 and the cap 320. The seal helps to prevent contamination and deterioration of record media (See FIGS. 30–32), for example an archive quality paper information scroll, photograph, computer disc, optical disc, electronic memory, hologram, or other storage media contained within the body 310 of the receptacle 140. The seal helps ensure that the record media remains undamaged and can therefore be used to identify the contents and location of the vault 100 over considerable time, for example a century or more. The groove 324 on the cap 320 may be adapted to receive the O-ring or any other suitable sealing agent 330. In some situations, such as when the sealing agent is putty or a sealing tape, the groove 324 may be omitted.

The hollow body 310 preferably may have a closed end 314 and an open end 312. Those skilled in the art will appreciate that the body 310 could also include two open ends with associated caps and seals. The record media is placed into the body 310 of the record receptacle 140. The cap 320 can then be retained on the body 310, for example by screw threads 410 and 420 as shown in FIG. 3, to enclose the record media within the receptacle 140. In operation, the sealing O-ring 330 is placed within the groove 324 of the cap 320 and the cap 320 is then screwed into the body 310 by engaging threads 410 and 420. The cap 320 is rotated with the aid of a gripping portion 322 that may have a knurled or other rough surface 316 that facilitates gripping and rotation. When the cap 320 is screwed into the body 310 it presses against the sealing agent 330 and retains the record media protected against the elements.

It should be appreciated that the screw threads 410 and 420 of the cap 320 and body 310 could be either right or left handed. Left handed threads may be preferred in order to discourage casual opening of the record receptacle 140. Also, the record receptacle 140 may be made in shapes other than cylindrical, although a cylindrical shape is preferred. As an example, the receptacle 140 could have a rectangular or square cross-section, or be shaped to form a globe or any other desired geometric shape.

FIG. 3 illustrates the body 310 having female threads 410 and the cap 320 having male threads 420. Alternative configurations of the cap 320 may be used. For example, the cap 320 could have female threads that would preferably mate with male threads on the body 310. Additionally, the body 310 could include a groove like the groove 324 to accommodate a sealing O-ring; in addition to or instead of the O-ring 330 of the cap 320. Additional embodiments for attaching the cap 320 to the body 310 are possible. For example, a bayonet lock could be used to attach the cap 320. Additionally, a pressure fit or friction fit method could be used to attach the cap 320 to the body 310. Additionally, the threaded portion 420 of the cap 320 could be hollow to receive at least a portion of the record media, for example the end portion of a paper scroll.

As can be seen in FIGS. 3 and 4, axial grooves 510 and radial grooves 520 are located on the body 310. The axial grooves 510 and radial grooves 520 aid in anchoring the body 310 when it is cast and embedded within the base 120 or lid 110 of a vault 100. Thus, when the base 120 or lid 110 are formed, for example, by wet, viscous concrete, the receptacle 140 is at least partially immersed in the viscous concrete and held in place until the concrete hardens and cures. The receptacle 140 is therefore retained in a fixed position within the concrete by engagement of the concrete with the grooves 510 and 520, despite axial or torsional forces that may be applied in manufacturing or when the cap 320 is rotated.

Of course, the grooves 510 and 520 shown in FIGS. 3 and 4 may be altered in different embodiments. For example, the depth of the axial grooves 510 and radial grooves 520 may vary, as may the number and shape of grooves. The body 310 of the receptacle 140 may contain any number of axial grooves 510. Likewise, the number of radial grooves 520 may vary. Additionally, the axial grooves 510 may extend any length of the body 310, including the entire length of the body 310, intersecting with the radial grooves 520 and continuing. Likewise, the radial grooves may have varying lengths that do not extend around the entire circumference of the body. The width of the axial grooves 510 and the circular grooves 520 may also be varied. Also, a single groove formed, for example in the shape of a spiral, may be used to resist lateral and axial movement of the embedded receptacle.

Figure 5:
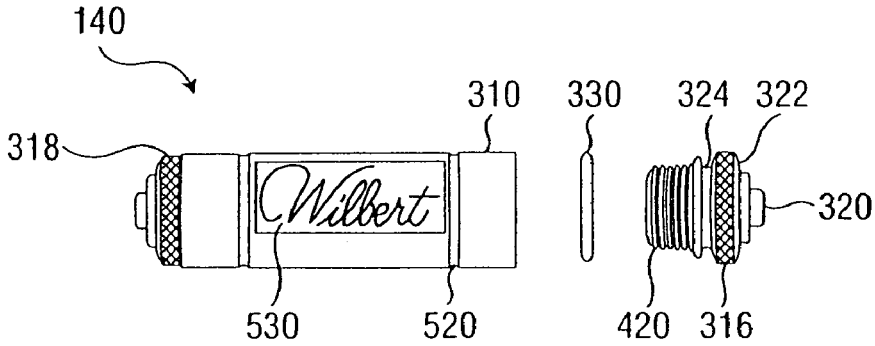
FIG. 5 represents an exploded side view of an embodiment of the record receptacle, including a body with a decorative closed end, a sealing O-ring, and the cap with threads.

FIG. 5 illustrates an additional embodiment of the record receptacle 140. The body 310 has circular grooves 520, a script box 530, and a decorative closed end 318 with a knurled surface such as 316. The script box 530 may contain any pertinent information, including, but not limited to: the deceased's name, date of death, or receptacle manufacturer. Additionally, the embodiment shown in FIG. 5 has a sealing agent 330, such as an O-ring, and a cap 320 with a groove 324 and threads 420. In an alternate embodiment, the body 310 of the receptacle 140 could have axial grooves 510 as well as radial grooves 520. Also, various alternate sealing agents 330 and methods for attaching the cap 320 to the body 310 to contain the record media are available as previously discussed with regard to FIG. 3.

The body 310 and cap 320 may be constructed of various materials, including any substance that can withstand the elements, for example metal or non-metallic substances. In one embodiment the receptacle 140 is manufactured by precision computer numeric control (CNC) machining from brass bar stock. In another embodiment, the body 310 and the cap 320 are made of a non-metallic substance, for instance, the body 310 and the cap 320 could be composed of high performance plastic such as Ultra High Molecular Weight Polyethylene. The preferred method of making the non-metal receptacle 140 is through an injection molding process. While Ultra High Molecular Weight Polyethylene is the preferred non-metal substance for the receptacle 140, any substance of sufficient strength to withstand the elements is sufficient, such as LEXAN.

Figure 6:
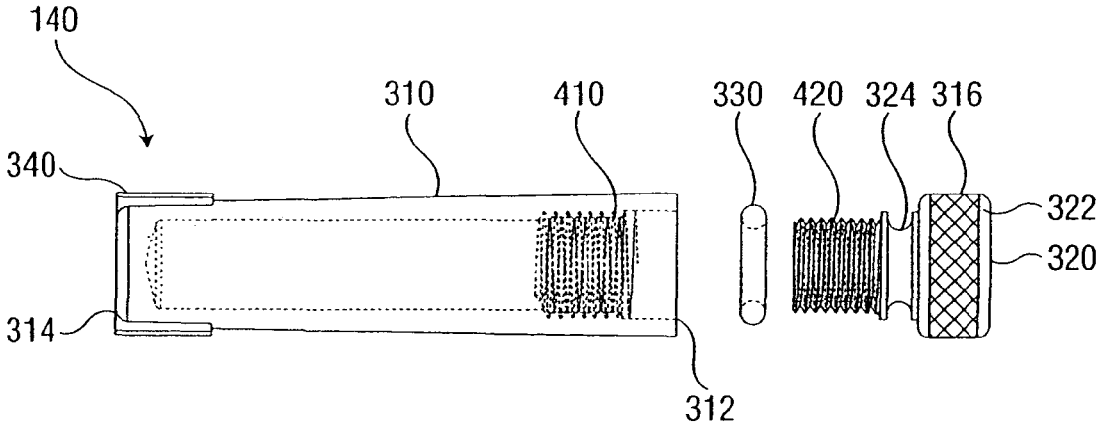
FIG. 6 represents an exploded side view of an embodiment of the record receptacle including the body with threads, the sealing O-ring, and the cap with threads.
Figure 7:
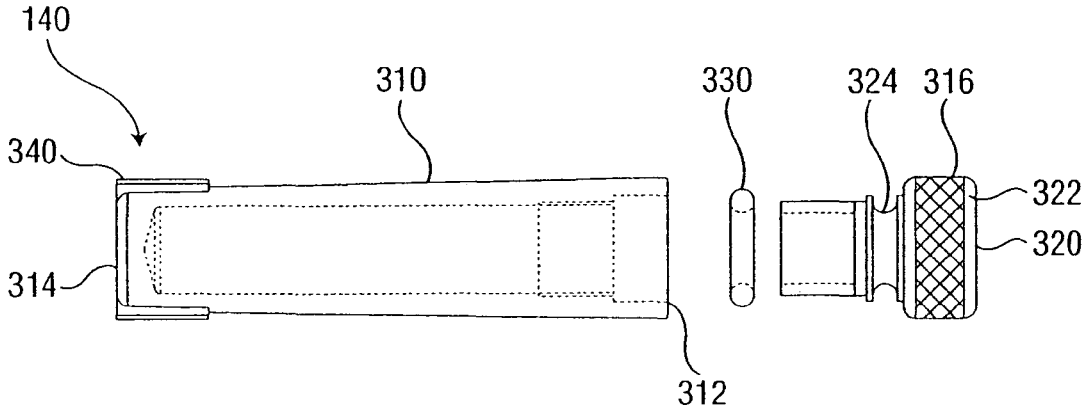
FIG. 7 illustrates an exploded side view of an embodiment of the record receptacle, including a body, a sealing O-ring and a cap for the receptacle.

FIGS. 6 and 7 show alternate embodiments of the record receptacle 140. The body 310 and the cap 320 shown in FIGS. 6 and 7 are made of Ultra High Molecular Weight Polyethylene. The embodiments shown in FIGS. 6 and 7 are preferably cylindrical, but may have any other desired shape. Axially extending stabilizing elements 340 aid in anchoring the body 310 of the receptacle 140 in the concrete wall of a vault by resisting axial and torsional forces. The preferred method of attaching the axially extending stabilizing elements 340 is to mold them directly to the body during the injection molding process. However, the axially extending stabilizing elements 340 may be attached by any means sufficient to secure them to the receptacle 140, such as gluing. The axially extending stabilizing elements 340 engage the concrete, retaining the receptacle 140 in a fixed position despite the axial or torsional forces that may be applied during manufacturing or when the cap 320 is rotated. The axially extending stabilizing elements 340 perform a function similar to the axial grooves 510 and radial grooves 520 shown in FIGS. 3 through 5. The preferred embodiments of the non-metal receptacle 140 use axially extending stabilizing elements 340 to prevent a weakening of the integrity of the body 310 of the receptacle 140. Placing grooves in the sides of a non-metal body 310 may provide flex points, weakening the body 310; therefore, the use of the axially extending stabilizing elements 340 is preferred to ensure the contained record media remains undamaged. Of course, if the body 310 is sufficiently thick, axial grooves 510 and/or radial grooves 520 could be added to the body 310.

It should be noted that the dimensions and number of the axially extending stabilizing elements 340 may vary. As an example, the axially extending stabilizing elements 340 may extend the length of the body 310 or may be shorter than illustrated in FIGS. 6 and 7. Also, the axially extending stabilizing elements 340 could be of any thickness sufficient to aid in anchoring the body 310 of the receptacle 140 to the vault 100. The number of axially extending stabilizing elements 340 could vary to any number sufficient to aid in anchoring the body 310 of the receptacle 140 to the vault 100.

The embodiments of FIGS. 6 and 7 differ in the manner in which the cap 320 is sealed to the body 310. As shown in FIG. 6, the cap and body may be engaged and sealed by mating threads. In FIG. 7, the cap and body are engaged by a friction or pressure fit. Additionally, the cap could be attached with a glue or adhesive.

The record receptacle 140 described in FIGS. 1 through 7 is preferably approximately 4 inches (10.16 cm) in length and 1 inch (2.54 cm) in diameter. This size seems sufficient to contain two or more scrolls of archival grade paper with identifying information. While these dimensions approximate the size of preferred embodiments, the record receptacle 140 may be of any size needed to contain desired record media, which includes any of the aforementioned alternatives.

Figure 8:
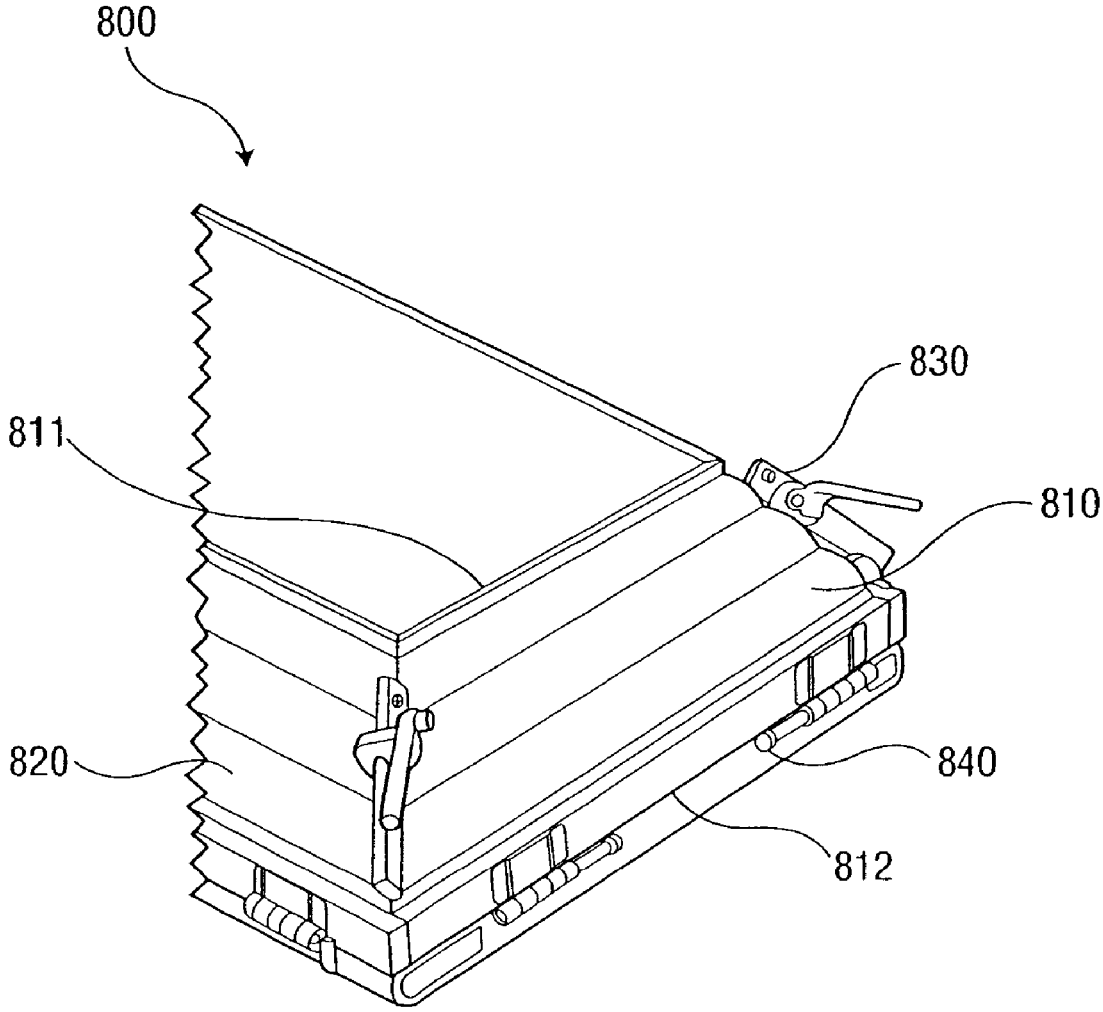
FIG. 8 is a perspective view of an exemplary form used to cast a lid of a burial vault.

FIG. 8 illustrates a form 800 that is used to cast the lid 110 of a concrete vault 100 (see FIG. 1) in a known manner. The form 800 has walls that are fitted and held together by clamps 830 to define a cavity for receiving wet, viscous concrete 2110 (see FIG. 20) which then hardens to form the lid 110 (see FIG. 21). The illustrated known form 800 is modified to embed the record receptacle 140 within the lid 110 when it is cast.

Figure 9:
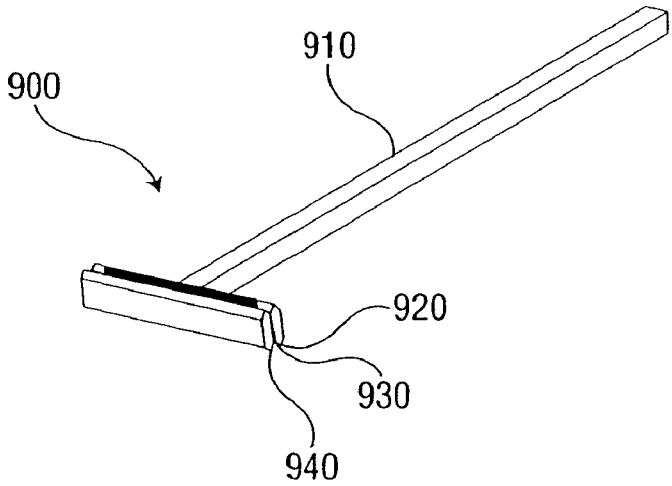
FIG. 9 is a perspective view of a rail repair tool.
Figure 10:
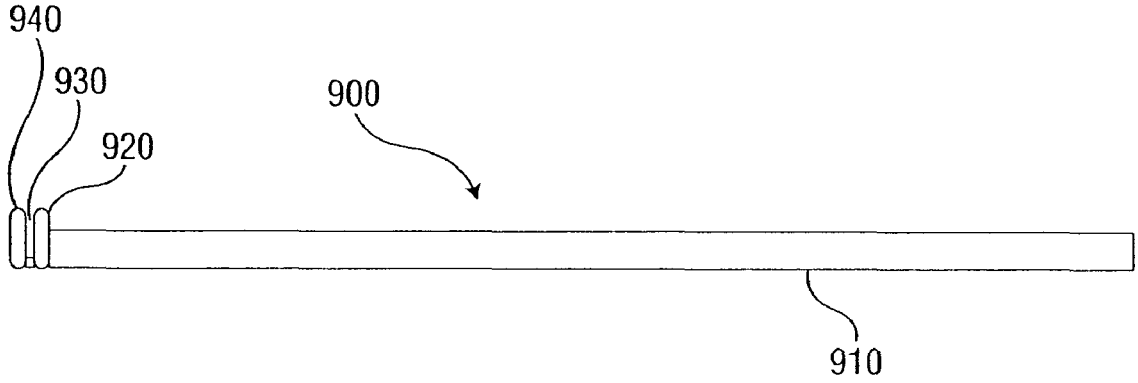
FIG. 10 is a side view of the rail repair tool.

When retrofitting the form 800 to embed a receptacle 140, the form should be in good condition, for example, not bent, to properly form the lid 110 and accommodate the record receptacle 140. Cover rails 810 that are heavily worn, bent, or out of square should be repaired or replaced before beginning to retrofit a receptacle. The top edge of a rail 811 can be straightened using a repair tool 900 shown in FIGS. 9 and 10. In operation, as shown in FIGS. 9 and 10, the top edge of the rail 811 is placed in a rail receiving slot 930 between a first bar 920 and a second bar 940 of the rail repair tool 900. The first bar 920 and the second bar 940 provide surfaces that abut the top edge of the rail 811. The top edge of the rail 811 may then be straightened by applying force to a handle 910 of the rail repair tool 900. Once the top edge of the rail 811 is straightened, the form 800 is ready to be fitted with a record receptacle 140 so that the receptacle 140 can be cast within the concrete lid 110.

The record receptacle 140 is preferably attached to the end rail 810 of FIG. 8, however, the placement of the record receptacle 140 is not limited to this location. The record receptacle 140 may be alternatively positioned along either one of the long sides 820 of the form 800. A record receptacle assembly 1300 (shown in FIG. 13) must hold the body 310 of the record receptacle in place during casting of the lid 110 of the vault 100. In order to do this, the end rail 810 is first removed from the form 800 by disengaging hinge pins 840.

Figure 11:
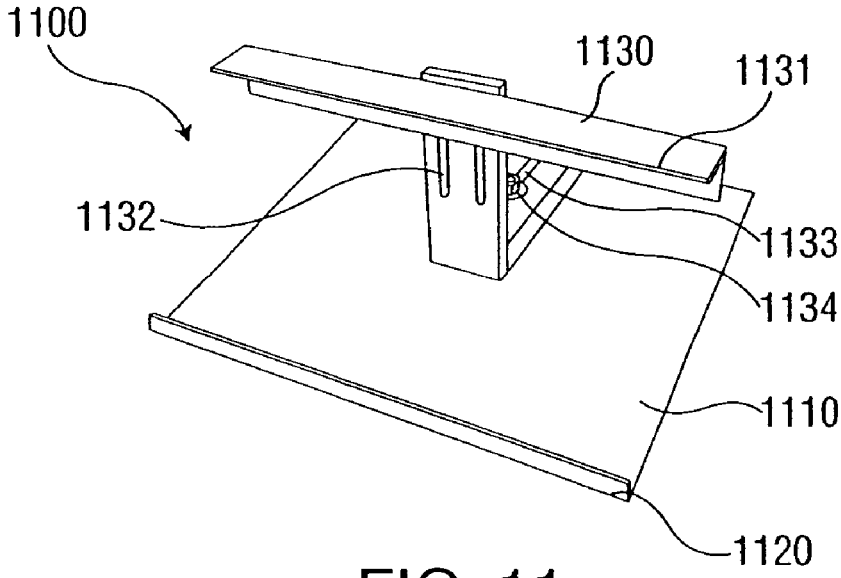
FIG. 11 is a front perspective view of a rail fixture.
Figure 12:
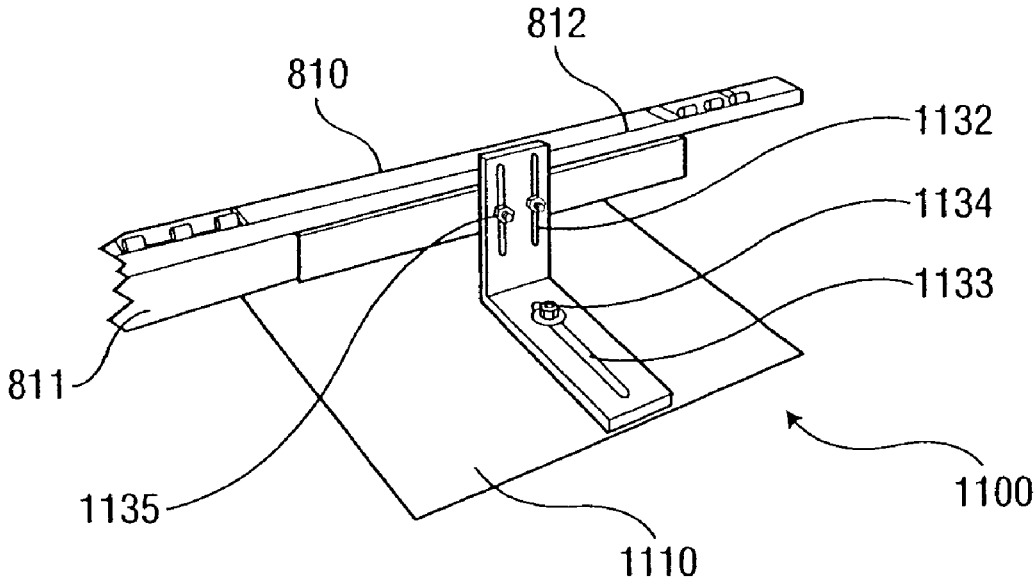
FIG. 12 is a rear perspective view of the rail fixture holding a rail end.
Figure 13:
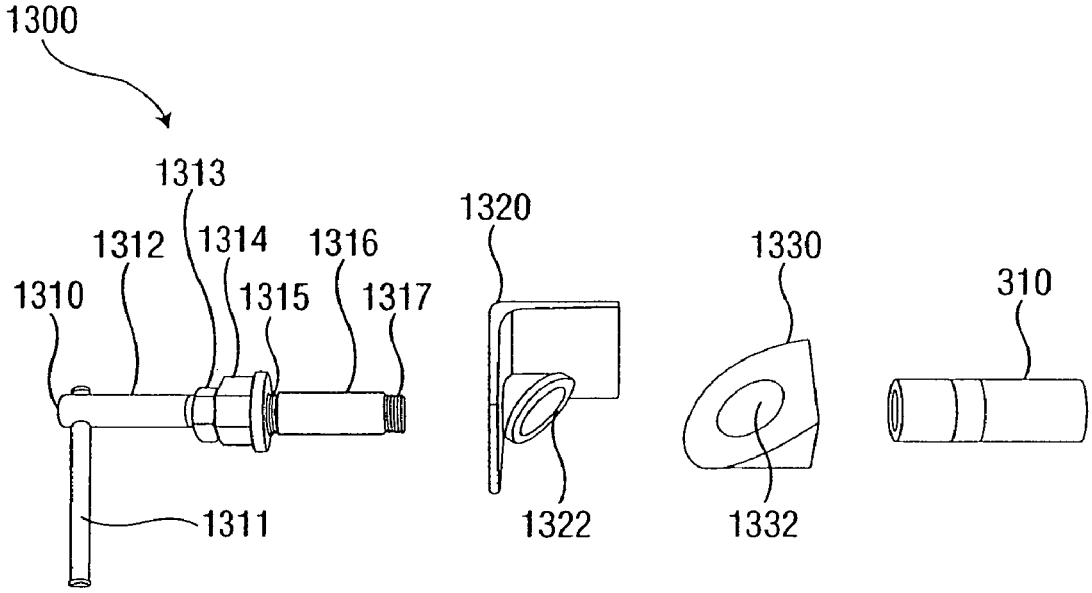
FIG. 13 is a perspective view of an insertion tool, an angle bracket, a boot and a body of the receptacle.

A rail fixture 1100, illustrated in FIGS. 11 and 12, is used to support and balance the end rail 810 during the process of fitting the body 310 of the receptacle 140 of FIG. 13 to the end rail 810. The end rail 810 is placed in the rail fixture 1100 as shown in FIG. 12. The rail fixture 1100 has a front lip 1120 that braces either the top edge 811 or the bottom edge 812 of the end rail 810 in a fixed position. The rail fixture 1100 also includes an L-shaped support arm 1130 that includes a support edge 1131 that braces either the top edge 811 or the bottom edge 812 of the end rail 810. The position of the support arm 1130 may be adjusted to hold the end rail 810 in various positions. The lateral position of the support arm 1130 may be adjusted by sliding the arm 1130 along an adjustment groove 1133 and locking it into position by tightening a base nut 1134. Additionally, the support edge 1131 may move vertically along adjustment grooves 1132 and may be locked into position by tightening adjacent support nuts 1135 (shown in FIG. 12).

The record receptacle assembly 1300, illustrated in FIG. 13, is used to hold the body 310 of the record receptacle on the form 800 for casting with the lid 110 or walls of the base 120 of the vault 100. In order to accommodate placement of the record receptacle 140, the end rail 810 is placed in the rail fixture 1100 with the top edge 811 of the end rail 810 located parallel to the front lip 1120 of the rail fixture 1100. This parallel alignment is required to ensure that the record receptacle 140 is positioned correctly with respect to the rail 810.

Figure 14:
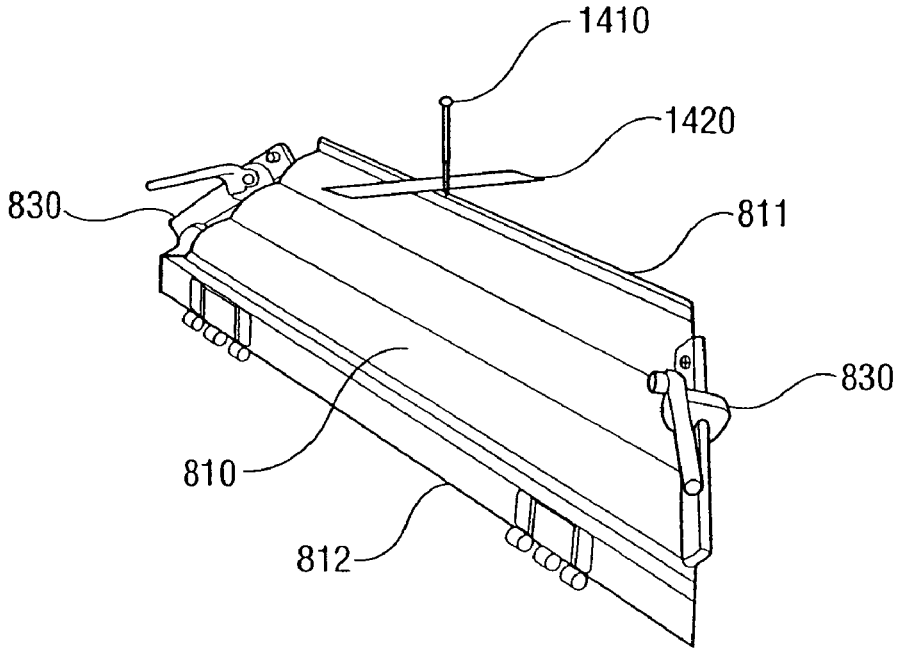
FIG. 14 is a perspective view of the form showing a line being scribed at the center of the top edge of the end rail of the form.
Figure 15:
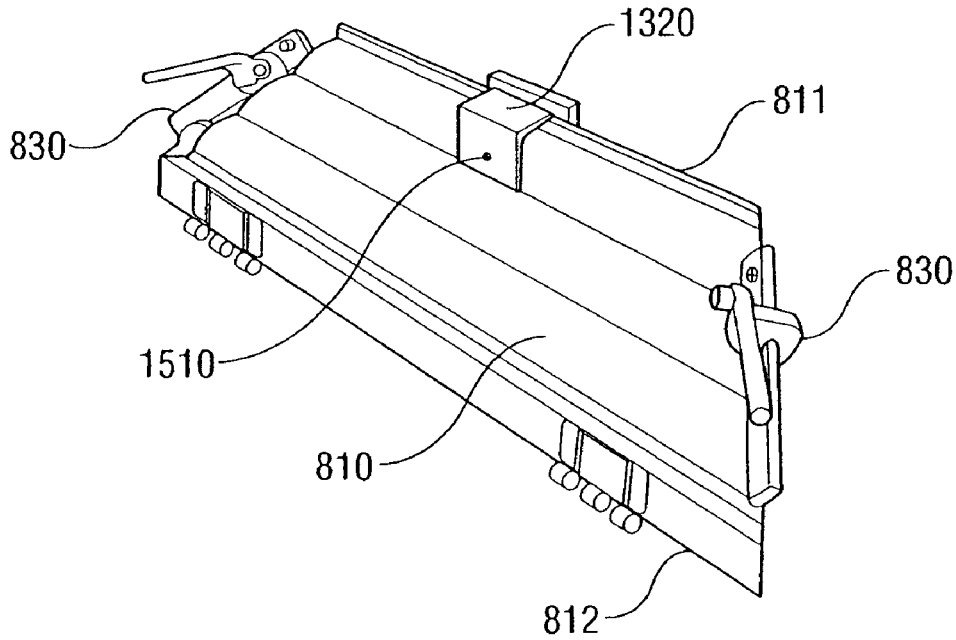
FIG. 15 is a perspective view of the end rail with the angle bracket attached.

As illustrated in FIG. 14, a measurement is taken to find the middle of the top edge 811 of the end rail 810. A centerline is scribed, for example with an awl 1410, on the front of the end rail 810. The scribed line is used to line up the center of the angle bracket 1320 of FIG. 13, with the center of the rail 810, as shown in FIG. 15. The angle bracket 1320 is attached in this center position to the end rail 810, for example by welding. Before drilling, the position of the angle bracket 1320 is checked relative to the end rail 810 to ensure that the angle bracket 1320 is still in its correct center position.

Figure 16:
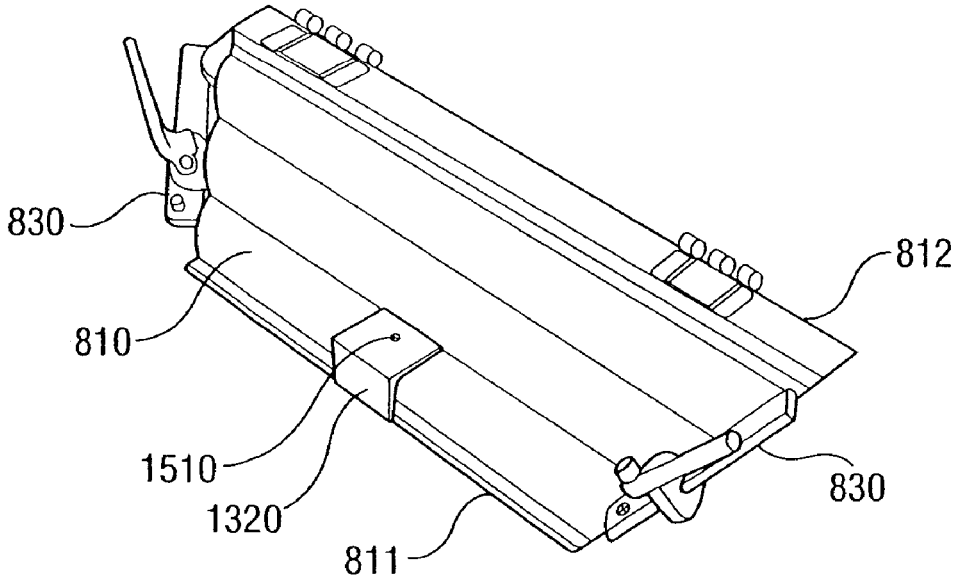
FIG. 16 is an upside-down perspective view of the end rail of FIG. 15.

As shown in FIGS. 12 and 16, the end rail 810 is then positioned in the rail fixture 1100 so that the top edge 811 of the end rail 810 is supported by the front lip 1120 of the rail fixture 1100. The end rail 810 and rail fixture 1100 are positioned in a drill press and a pilot hole is drilled in the end rail 810 through the preexisting pilot hole 1510 in the angle bracket 1320. Preferably, the drilling is performed slowly to prevent the drill bit from walking on the rounded surface of the end rail 810. Next, the pilot hole 1510 is used as a guide to drill a larger hole with a drill bit that will produce a hole only slightly larger than the diameter of a shaft 1316 of an insertion tool 1310 illustrated in FIG. 13, so that the insertion tool 1310 can enter the larger drilled hole. In the preferred embodiment it is important that the hole in the angle bracket 1320 and end rail 810 is only slightly larger than the diameter of the shaft 1316 of the insertion tool 1310 so that the shaft fits relatively tightly in the hole.

The tight fit of the shaft 1316 of the insertion tool 1310 ensures that the body 310 of the receptacle 140 remains in a fixed position during a later process step when concrete is poured to cast the lid 110 and embed the receptacle. If the hole in the angle bracket 1320 and/or the end rail 810 is too large, the body 310 may move during the casting of the lid 110 when the form 800 is vibrated or sawed. Gaps in the concrete 2110 could form around the body 310 if it moves. These gaps could weaken the bond between the body 310 and the concrete 2110, thereby reducing the permanence of the receptacle 140. Of course, alternate methods for securing the body 310 during casting are available. For example, the body 310 could be held in place with a clamp or other stabilizing mechanism.

The pilot hole is drilled to facilitate forming the final hole in the end rail 810. The pilot hole in the rounded surface of the end rail 810 helps to prevent the large diameter drill bit from walking on the rounded surface of the end rail 810. The inside of the angle bracket 1320 also has a guide tube 1322 (shown in FIG. 13) that operates in conjunction with the pilot hole in the end rail 810 to prevent the drill bit for the larger hole from walking. The surface of the end rail 810 and angle bracket 1320 may need to be filed to remove any burrs and thereby allow smooth and unobstructed placement of the insertion tool 1310 into the hole formed in the bracket 1320 and end rail 810. The end rail 810 is then disengaged from the fixture 1100 and attached to the form 800 by engaging the hinge pins 840.

Figure 17:
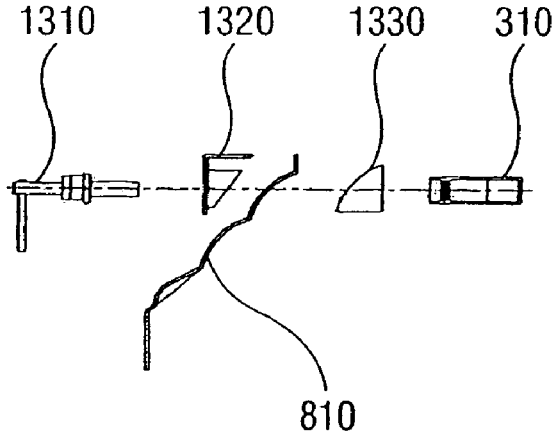
FIG. 17 illustrates an exploded side view of the insertion tool, the angle bracket, the end rail, the boot, and the body of the record receptacle.
Figure 18:
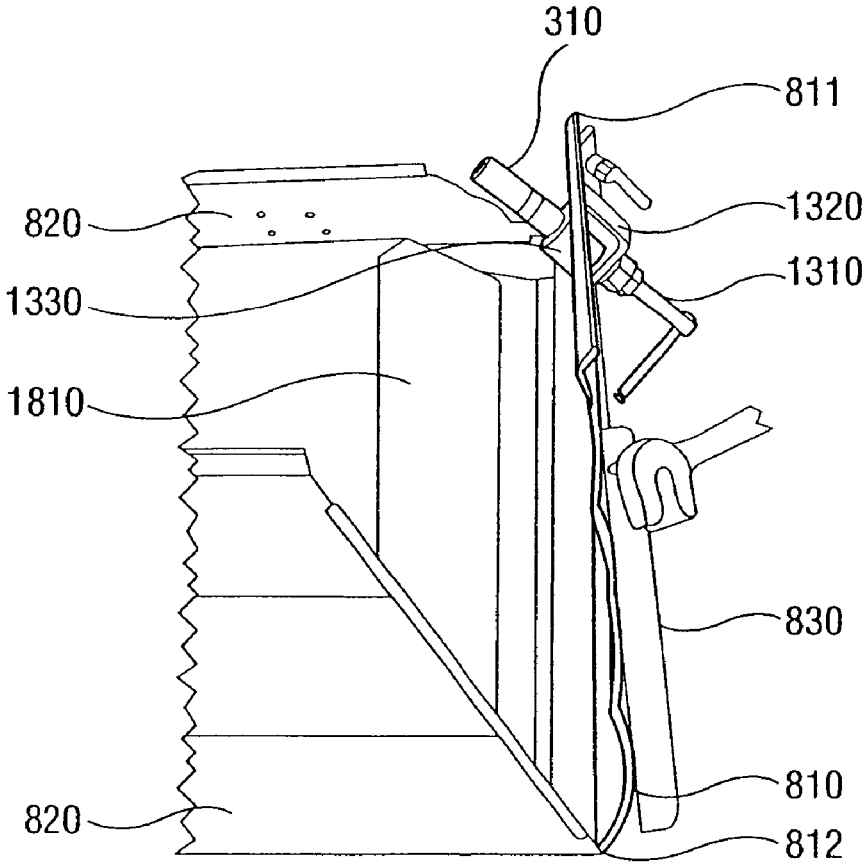
FIG. 18 is a top and side perspective view of the form with the end rail open and being fitted to cast the record receptacle.

FIG. 17 illustrates an exploded side elevation view of the record receptacle assembly 1300, including the end rail 810. To assemble the record receptacle assembly 1300, the insertion tool 1310 is placed through the hole drilled in the angle bracket 1320 and the end rail 810, as shown in FIG. 18. A boot 1330 is placed on the exposed end of the shaft 1316 of the insertion tool 1310, which is located on the inside surface of the end rail 810 as shown in FIG. 18. The length of the exposed shaft 1316 of the insertion tool 1310 is adjusted to extend beyond the end of the boot 1330 by moving a jam nut 1314 (See FIG. 13). The shaft threads 1317 of the insertion tool 1310 should extend far enough beyond the rear surface of the boot 1330 to allow the body 310 of the associated record receptacle 140 to screw onto the threads 1317 of the insertion tool 1310, preferably three full revolutions. Screwing a locking nut 1313 tight against the jam nut 1314 tightens the position of the jam nut 1314. The body 310 of the record receptacle 140 should be tight against the boot 1330 in order to aid in the creation of a seal between the body 310 and the boot 1330 and thereby prevent seepage of concrete 2110 during casting.

Figure 19:
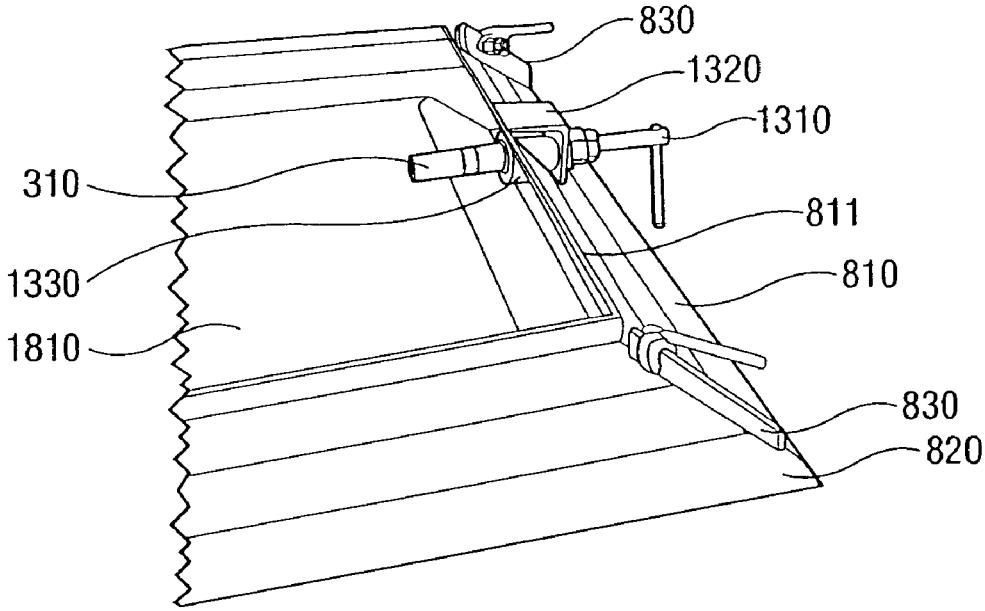
FIG. 19 is a top and side perspective view of the closed form which has been retrofitted to cast the record receptacle.

FIG. 18 shows the record receptacle assembly 1300 installed on the end rail 810. Once the end rail 810 is reattached to the form 800 with clamps 830 as shown in FIG. 19, the body 310 of the record receptacle 140 should be held rigidly in place, perpendicular to the top edge 811 of the end rail 810 and extending within an enclosed space defined by the walls of the form 800. Additionally, the body 310 should be positioned substantially parallel to the side rails 820 of the form 800.

A bonding agent such as an epoxy adhesive is next applied to the body 310. UNIDEX, disclosed in U.S. Pat. No. 5,203,810 or STICKUM, disclosed in U.S. Pat. No. 3,787,545, are known epoxy resins. Either one of these resins is applied to the surface of the body 310 of the record receptacle 140 and is allowed to dry to a tacky consistency before casting. In general, UNIDEX is the preferred adhesive, although STICKUM or other like adhesives could be used as alternatives.

The end rails 810, the side rails 820 and the boot 1330 are coated with form oil, such as Wilbert part #H137, manufactured by Perkins Products, headquartered in Bedford Park, Ill. While using the above-mentioned form oil is preferred, other concrete release agents are available and may be used in place of Wilbert part #H137. Water-based or oil-based concrete release agents, such as mineral oil are available. Preferably, the concrete release agents do not include solvents, such as diesel fuel, that may contain hydrocarbons that may degrade substances such as plastic.

Care should be taken to prevent form oil from seeping into the interior of the body 310 of the record receptacle 140. Contamination of the record receptacle 140 could lead to contamination of the record media that will be enclosed in a later process step. Over time, contamination of the record media could result in a loss of its archival properties, thereby making identification more difficult.

Once the epoxy adhesive has been applied, time is allowed for it to vent. When initially applied, the epoxy is wet, and as the solvent from the epoxy evaporates, the epoxy becomes tacky. The epoxy should be allowed to vent for approximately 30 to 60 minutes. By allowing the solvent to evaporate, the epoxy provides for better adhesion of the body 310 of the record receptacle 140 to the concrete of the burial vault 100 when the concrete is poured in a later process step and the receptacle is embedded in the concrete.

When concrete is initially poured, it has a relatively high concentration of water. As the concrete sets, the water is released and the concrete shrinks. Normally, concrete shrinks uniformly, however, placement of the non-compressible material such as the record receptacle 140 in the concrete prevents the concrete from shrinking uniformly. The uneven shrinkage of the concrete adjacent to the receptacle 140 creates forces that cause the concrete to crack and form micro-fissures. These micro-fissures can weaken the overall structural strength of the concrete and loosen the receptacle 140 within the concrete so that it is not firmly embedded and will move when the cap 320 of the receptacle 140 is turned. The application of the epoxy to the exterior of the record receptacle 140 provides a flexible surface that clings to the concrete even as it moves. As the concrete shrinks, the epoxy flexes with the concrete and prevents the creation of micro-fissures and cracks which would otherwise appear in the concrete at the interface with the receptacle. The epoxy therefore anchors the receptacle within the concrete. If other relatively fast liquid diffusing substances are used instead of concrete, the epoxy should provide the same advantageous function.

The described way of using an adhesive or epoxy can also be used in other circumstances where a non-compressible object is embedded in a liquid diffusing substance, such as concrete. For example, the epoxy or adhesive could be used to coat re-bars placed in the concrete of buildings or roads. The epoxy or adhesive could also be applied to mail-box or deck posts, before they are placed in the concrete.

Figure 20:
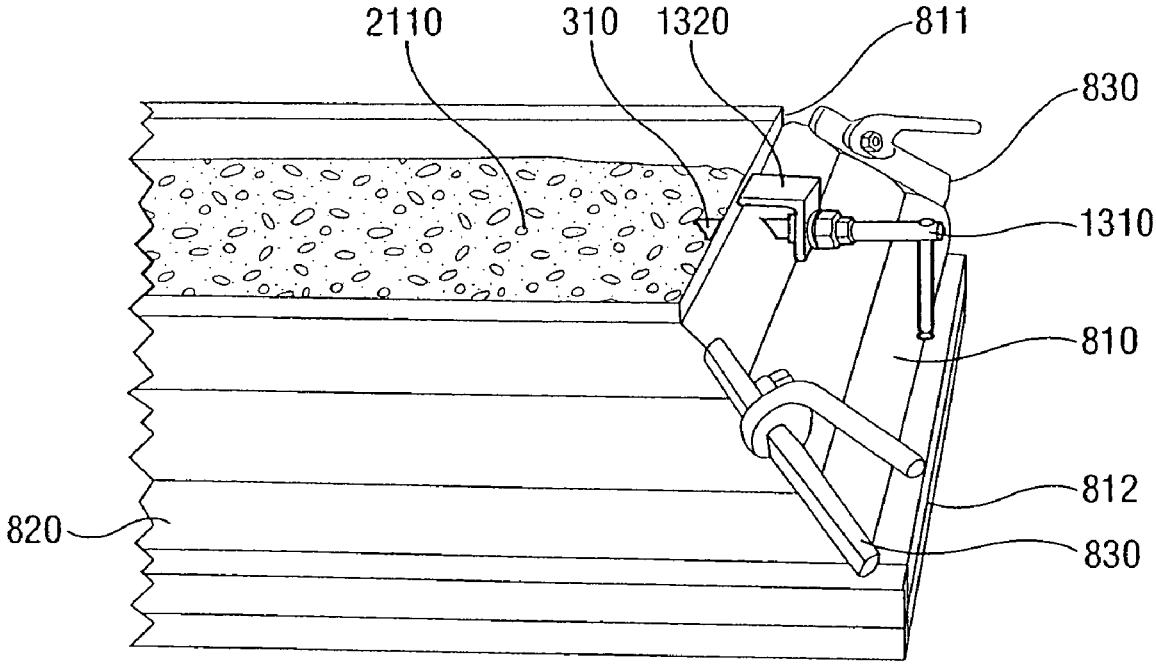
FIG. 20 is side view of the form fitted with the record receptacle and being filled with concrete.

Once the epoxy on the receptacle 140 has properly vented, the concrete 2110 is poured to fill the form, as shown in FIG. 20. The concrete 2110 is preferably poured beginning at the end without the receptacle 140. The form is vibrated while being careful not to damage the record receptacle 140. As is known by those skilled in the art, the concrete 2110 should also be sawed, i.e., pushed into all the recesses of the form so that no gaps form in the concrete 2110. Once the form 800 is filled with concrete 2110, the form 800 is screed, i.e., a smooth solid surface is moved across the top of the form 800 to level the concrete 2110.

Figure 21:
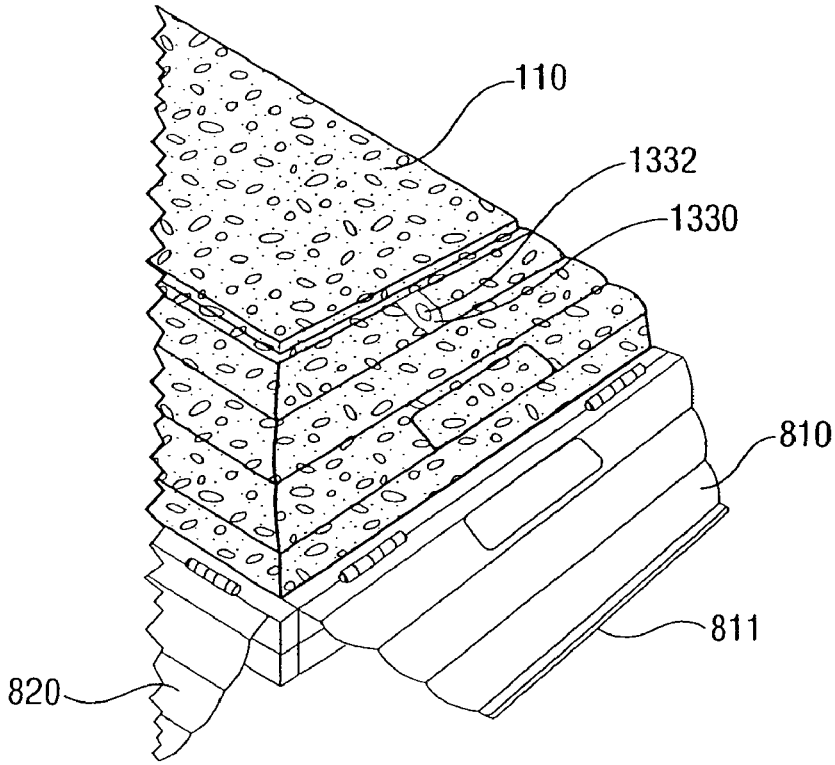
FIG. 21 is a perspective view of the cast lid of the vault and the end and side rails being opened.

The initial setup of the concrete 2110 that forms the lid 110 can take approximately 3 to 5 hours, depending on the concrete 2110 that is used. Once the concrete 2110 has initially set, the insertion tool 1310 is unscrewed from the body of the receptacle and removed from the form 800. The grooves in the surface of the receptacle ensure that it does not turn when the insertion tool is removed. The clamps 830 are then released and the end rails 810 and the side rails 820 are turned down as shown in FIG. 21. The boot aperture 1332 is filled with a clean sponge or plug to prevent debris from entering the body of the record receptacle.

Figure 22:
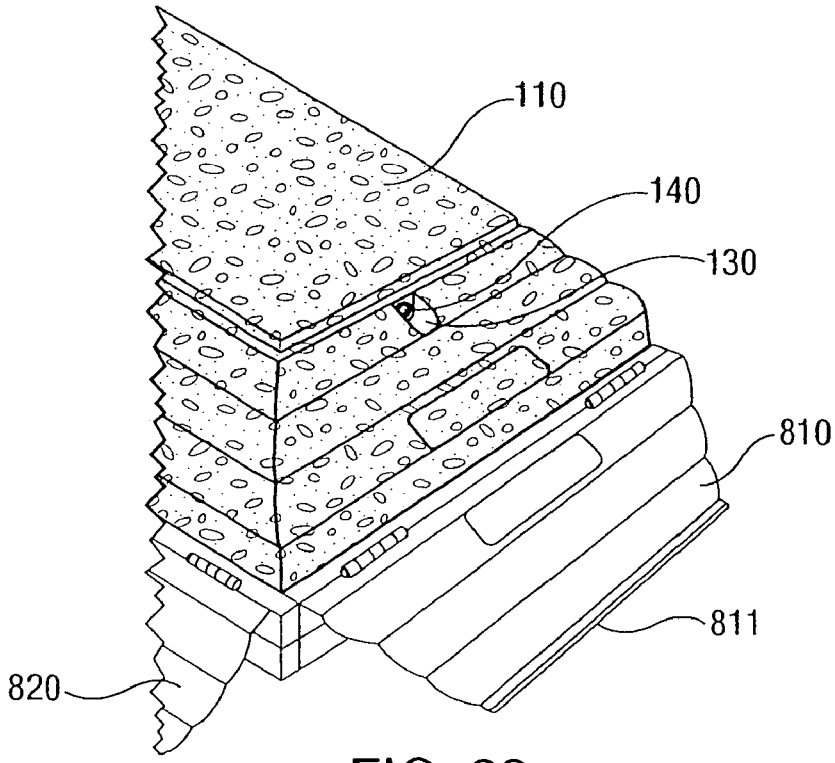
FIG. 22 is a perspective view of the cast lid with the boot removed.

The exterior surface of the lid 110 of the vault 100 may then be brushed to smooth any imperfections in the concrete 2110. If necessary, voids in the partially set concrete may be filled and then brushed. A flint abrasive, such as stone or crushed quartz, may be applied to the surface for aesthetic purposes. Once surface brushing is complete, the boot 1330 is removed, as shown in FIG. 22, to expose the recessed end of the receptacle. The exposed open end of the receptacle is plugged to insure no debris contaminates its interior, as this may compromise the seal and archival properties of the record media that will be later inserted. The concrete is then allowed to harden to its final set.

The removal of the boot 1330 forms a recess 130 in the lid 110 of the vault 100 that helps to protect the record receptacle 140 from damage. Although the boot 1330 may be made of any substance that can be released from concrete; the preferred boot 1330 is made of SANTOPRENE 55D, manufactured by Advanced Elastomer Systems, Headquartered in Akron, Ohio. With the boot 1330 removed, the recess 130 prevents damage to the receptacle 140 by objects that may come into contact with the vault 100 when it is buried. For example, when the vault 100 is buried, the recess 130 can prevent damage to the receptacle 140 by a digging tool such as a shovel or backhoe bucket. That is, the shovel or backhoe bucket can scrape over the surface of the vault 100 without touching the recessed receptacle 140. The recess 130 further provides protection against damage if the vault 100 is dislocated by a natural disaster. In such a case, objects may come into contact with the vault 100 and the recess 130 will help to prevent the objects from striking the receptacle 140 and potentially destroying the record media contained therein.

While embedding the record receptacle 140 in concrete 2110 has been discussed in detail, the use of the receptacle 140 is not limited to concrete structures. The record receptacle 140 may be used in conjunction with vaults 100 or other containers made of other substances such as, but not limited to, steel, thermoplastic, or CORIAN. Also, it should be appreciated that the described manufacturing method may be embodied in the form of a kit with written instructions to allow manufacturers of burial vaults to retrofit their forms under license in order to accommodate record receptacles. Of course, the kit could be altered to accommodate different embodiments and placements of the record receptacle 140. For example, the kit with written instructions could implement pre-cast placement of the body 310 in the lid or base of the vault as previously described. Alternatively, a post-cast method of attaching the receptacle 140 to the vault could be implemented, as will be described hereinafter.

In the preferred embodiment the fixed and rigid position of the body 310 of the receptacle is required in order to avoid interference with a carapace 2910 or decorative cover (shown in FIG. 28) that may be added to the top of the lid 110 of the vault 100. The carapace 2910 is typically made of metal or other decorative material and may be filled with concrete. It is known in the industry to affix the carapace 2910 by two methods. The first method is a post-cast attachment. That is, the carapace 2910 may be attached after the lid 110 has hardened. In this method the carapace 2910 is usually attached with an epoxy resin, or other adhesive such as UNIDEX or STICKUM. The carapace 2910 may then be weighted until the adhesive dries. The second method is a pre-cast attachment. In this method the carapace 2910 is attached to the lid 110 of the vault 100 before the concrete 2110 of the lid hardens. Prior to mixing and pouring the concrete for the lid 110, the carapace requires preparation. In preparing the carapace, posts or wires are affixed to the underside extending away from the carapace. The underside of the carapace, including the extending posts or wires, is coated with UNIDEX or STICKUM and allowed to vent as previously discussed. The carapace 2910 is then filled with concrete. Once the concrete has set, the carapace is ready and concrete for the lid may be mixed and poured. The hardened concrete of the underside of the carapace 2910 and the posts or wires are coated with UNIDEX or STICKUM and allowed to vent. The carapace 2910 is then placed on the wet concrete 2110 of the lid with the posts or wires extending into the concrete 2110. When the concrete of the lid sets, the carapace is anchored against the top of the lid by the embedded posts or wires and the adhesive.

The position of the body 310 of the receptacle 140 is particularly important when using the pre-cast method of attaching the carapace 2910. If the body 310 is not aligned substantially parallel to the side rails 820 of the form, the body 310 could interfere with the placement of the posts or wires when the carapace is disposed on the lid 110 of the vault.

Figure 23:
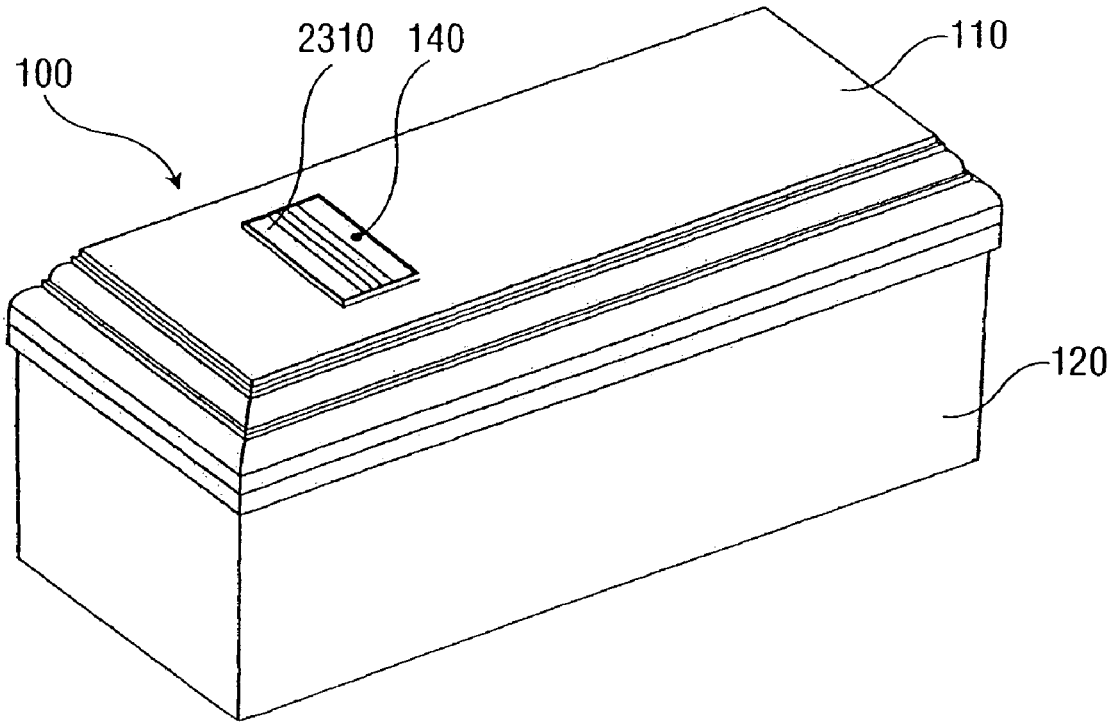
FIG. 23 is a perspective view of an embodiment with the receptacle shown embedded vertically in the lid of a burial vault.
Figure 24:
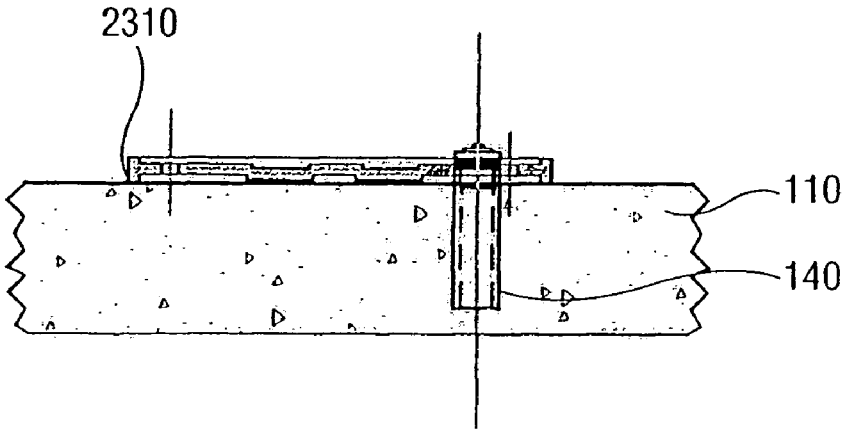
FIG. 24 is a side cutaway view showing the receptacle embedded vertically in the lid of a burial vault.

FIGS. 23 and 24 illustrate an alternate way to position the record receptacle 140 in the top of the lid 110 of a burial vault 100 and through a name plate 2310 that is made of metal and adhered to the lid 110. The receptacle 140 can be positioned in the lid 110 of the burial vault 100 such that the length of the receptacle 140 is located in a plane substantially perpendicular to the lid 110. Alternate positioning of the receptacle 140 is also possible. For example, the receptacle 140 could be placed at other angles in the lid 110 or at any desired position in any wall of the vault 100. Also, the receptacle 140 could lay within the vault 100 and multiple receptacles 140 could be used for a vault 100.

Figure 25:
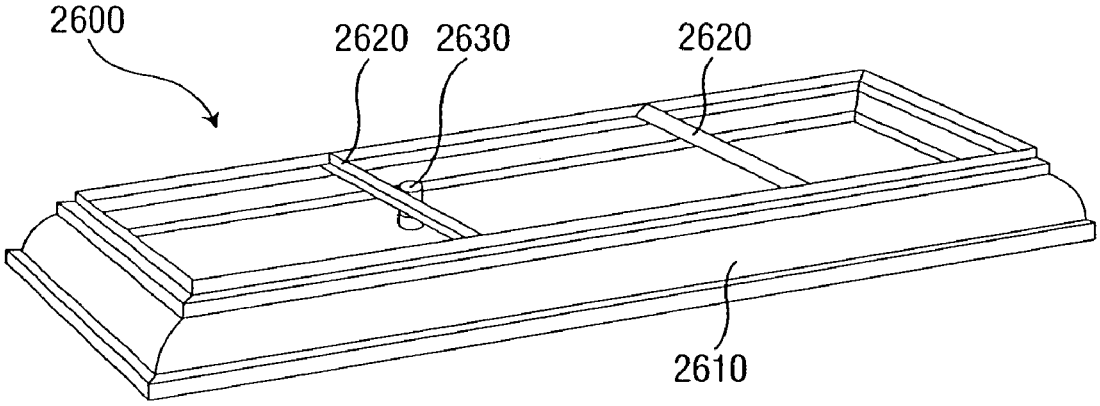
FIG. 25 is a perspective view of an alternative exemplary assembly used to cast the record receptacle vertically in the lid of the vault.
Figure 26:
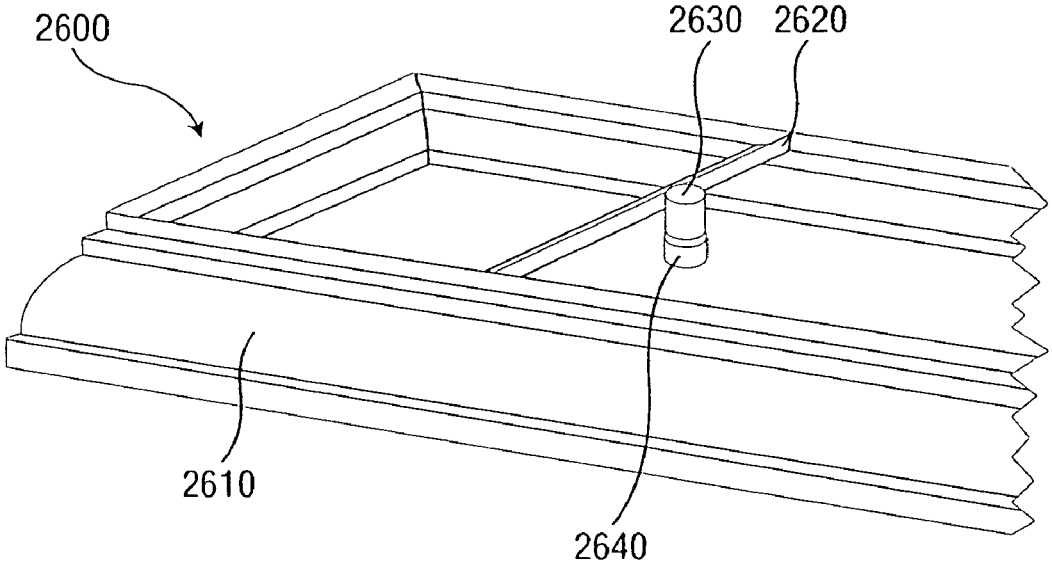
FIG. 26 is another perspective view of the alternative assembly, including a container that is used to support the record receptacle vertically in the lid of the vault.

FIGS. 25 and 26 illustrate a frame 2600 for casting a lid 110 of the vault 100 and providing decorative trim for the lid when it is formed. The frame 2600 includes rails 2610, support struts 2620, and a container 2630 that is intended to later receive a record receptacle 140 as previously described. The container 2630 therefore has a cross-section slightly larger than the cross-section of the record receptacle 140 that it will later retain. The preferred container consists of a metal tube 2630 with a cover 2640 attached. The cover 2640 may be attached to the container 2630 by any method sufficient to secure it, such as welding, gluing, or the preferred method of soldering. The container 2630 is attached to one of the support struts 2620. The frame 2600 may be made of various decorative materials including metal, or non-metal, for example plastic. Preferably, the frame 2600, including the rails 2610, the struts 2620 and the container 2630 are made of bronze to provide an impressive appearance. The struts 2620 and the container 2630 may be attached to the rails 2610 by various methods, including, but not limited to, soldering, welding or gluing. The frame 2600 in FIGS. 26 and 27 differs from the form 800 shown in FIG. 8 because the frame is intended to be an integral part of the finished lid, while the form 800 is intended only to make lids. The rails 2610 of the frame thus form the exterior of the lid 110 of the vault 100, whereas the end rails 810 and side rails 820 of the form 800 in FIG. 8 are used only to shape concrete multiple times in the process previously described.

In preparing to fill the frame 2600 with wet concrete 2810 (FIG. 27), the container 2630 is plugged to prevent entry of wet concrete 2810. Any plugging device or covering that prevents the container 2630 from filling with wet concrete will suffice. In the preferred embodiment the container 2630 is covered with tape. It should be appreciated that the plugging device could be altered, for example, a length of pipe or a rubber stopper that fits tightly in the container 2630 will suffice.

Figure 27:
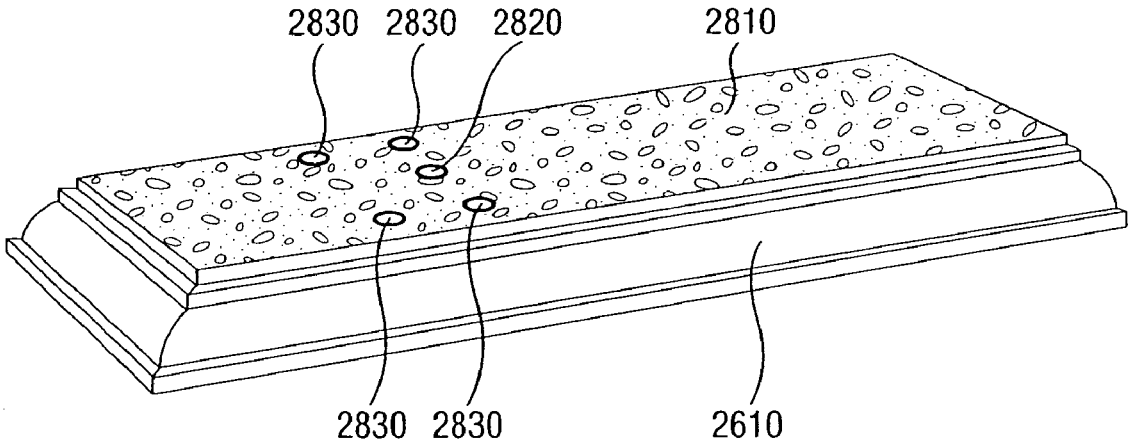
FIG. 27 is a perspective view of the lid assembly of FIGS. 25 and 26, filled with concrete.

Referring to FIG. 27, the frame 2600 is filled with wet concrete 2810. An aperture 2820 forms in the concrete 2810 around the plugged container 2630. Additionally, other holes 2830 are formed in the concrete 2810 during casting in a conventional manner, such as with a jig, to receive alignment posts 2920 for a carapace 2910 shown in FIG. 28. It should be appreciated that alternate methods of forming the aperture 2820 and the holes 2830 are available. For example, any material releasable from concrete such as plastic or SANTOPRENE may be placed in the wet concrete 2810 and later removed to create the aperture 2820 and holes 2830. It should also be appreciated that the aperture 2820 and the holes 2830 could be drilled into the concrete 2810 after it hardens. However, the preferred method is to form the aperture and holes without drilling the concrete. The concrete 2810 is then allowed to set and harden.

Figure 28:
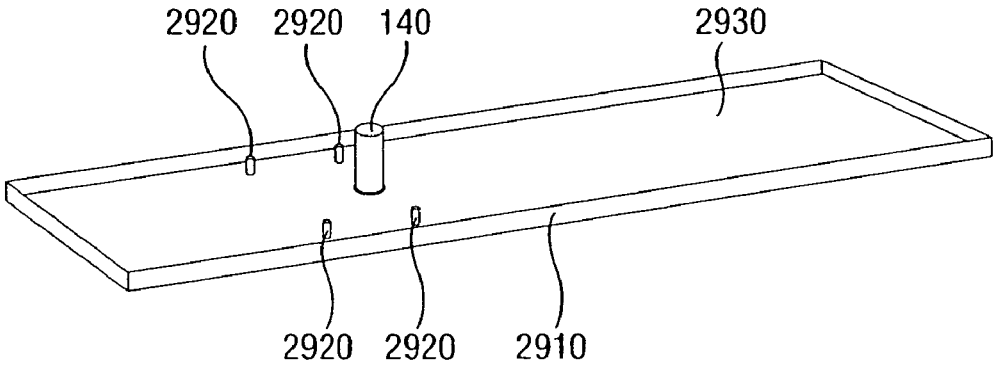
FIG. 28 is a perspective view of a carapace including the record receptacle and posts.

FIG. 28 shows a carapace 2910 made of bronze as an example. A nameplate 2310 (such as is shown in FIGS. 23 and 24) is attached to the top of the carapace 2910. The nameplate 2310 provides the name of the deceased and the date of death. It should be noted that the record receptacle 140 contains record media which provide the same information as the nameplate 2310 regarding the deceased; however, the record media are capable of containing more information for long term use. The record media sealed within the record receptacle 140 therefore provide a more permanent record than the nameplate 2310, because the record media are not exposed to the elements.

The carapace has alignment posts 2920 attached to its underside. The alignment posts are held in place by screws that affix the nameplate 2310 to the top of the carapace. The carapace has predrilled screw holes (not shown) that match corresponding holes in the nameplate. The nameplate and carapace also have aligned apertures to allow access to the record receptacle 140. Nameplate screws enter the holes in the nameplate 2310, continue through the matching predrilled holes in the carapace, and screw into the alignment posts 2920 on the underside of the carapace 2910. The alignment posts 2910 have a hollow center with threads that mate with the threads of the nameplate screws. Alternate methods of attaching the alignment posts 2920 are available. For example, the alignment posts 2920 could be glued, soldered, or welded to the carapace 2910. Additionally, the number or arrangement of the alignment posts 2920 may vary so long as the number is sufficient to aid in anchoring the nameplate to the carapace 2910. The alignment posts 2920 are positioned to mate with the holes 2830 in the concrete 2810. Additionally, the nameplate could be affixed to the carapace by various methods, including for example, gluing, soldering, or welding. Once the nameplate 2310 is attached to the carapace 2910, a record receptacle 140 as previously described is inserted through the aforementioned aligned apertures in the carapace and nameplate with the open end of the receptacle extending slightly through the opening in the nameplate, but recessed from the top surface of the nameplate, thereby making the open end of the receptacle 140 easily accessible from outside of the vault through the carapace and the nameplate. The receptacle 140 is then attached to the carapace 2910 by any method sufficient to secure the receptacle 140 in place. For example, the receptacle 140 may be glued, welded, or affixed by the preferred method of soldering. The record receptacle 140 is positioned on the carapace 2910 to mate with the aperture 2820 in the concrete 2810.

Once the concrete 2810 has set, the carapace 2910 is fitted on top of the framed concrete lid. The top surface of the lid and the under surface 2930 of the carapace 2910 are covered with an epoxy or adhesive which is also allowed to flow within the container 2630. The carapace 2910 is placed on top of the lid, so that the record receptacle 140 aligns with the aperture 2820 in the concrete 2810 and the alignment posts 2920 align with the holes 2830 in the concrete 2810. In the preferred embodiment the axially extending stabilizing elements 340 or the grooves 510 and 520 of the receptacle aid in attaching the receptacle within the container 2630 by providing a surface for the epoxy or adhesive to grip. While the preferred embodiment uses axially extending stabilizing elements 340 or grooves 510 and 520, it should be appreciated that the receptacle 140 may be attached within the container or to the vault without the axially extending stabilizing elements 340 or the grooves 510 and 520. Because the container 2630 is slightly larger in diameter than the record receptacle 140, a small amount of movement of the carapace 2910 is allowed to ensure proper alignment. To further aid the epoxy or adhesive in forming a strong bond between the lid and the carapace 2910, a weight may be placed on top of the carapace while the epoxy or adhesive dries. Once the epoxy or adhesive has dried, the weight is removed, and the record receptacle 140 is contained within the lid 110, substantially perpendicular to the base 120 of the vault 100. Record media may then be placed in the body 310 of the receptacle 140 and sealed with the cap 320 as previously discussed.

It should be appreciated that while the preferred method of attaching the record receptacle 140 to the vault 100 is casting the body 310 of the receptacle directly into the vault, alternate methods of attaching the record receptacle to the vault are available. For example, a hole could be drilled into the vault to receive the receptacle. The receptacle could then be attached to the interior of the hole by various methods, such as by using an epoxy resin, or other gluing agent. The method of casting the receptacle directly into the vault is preferred because it allows for greater precision in the placement of the receptacle. Casting the receptacle into the vault also ensures that post-setting work on the hardened concrete 2110 will not weaken the overall strength and integrity of the vault or the receptacle within the vault.

Figure 29:
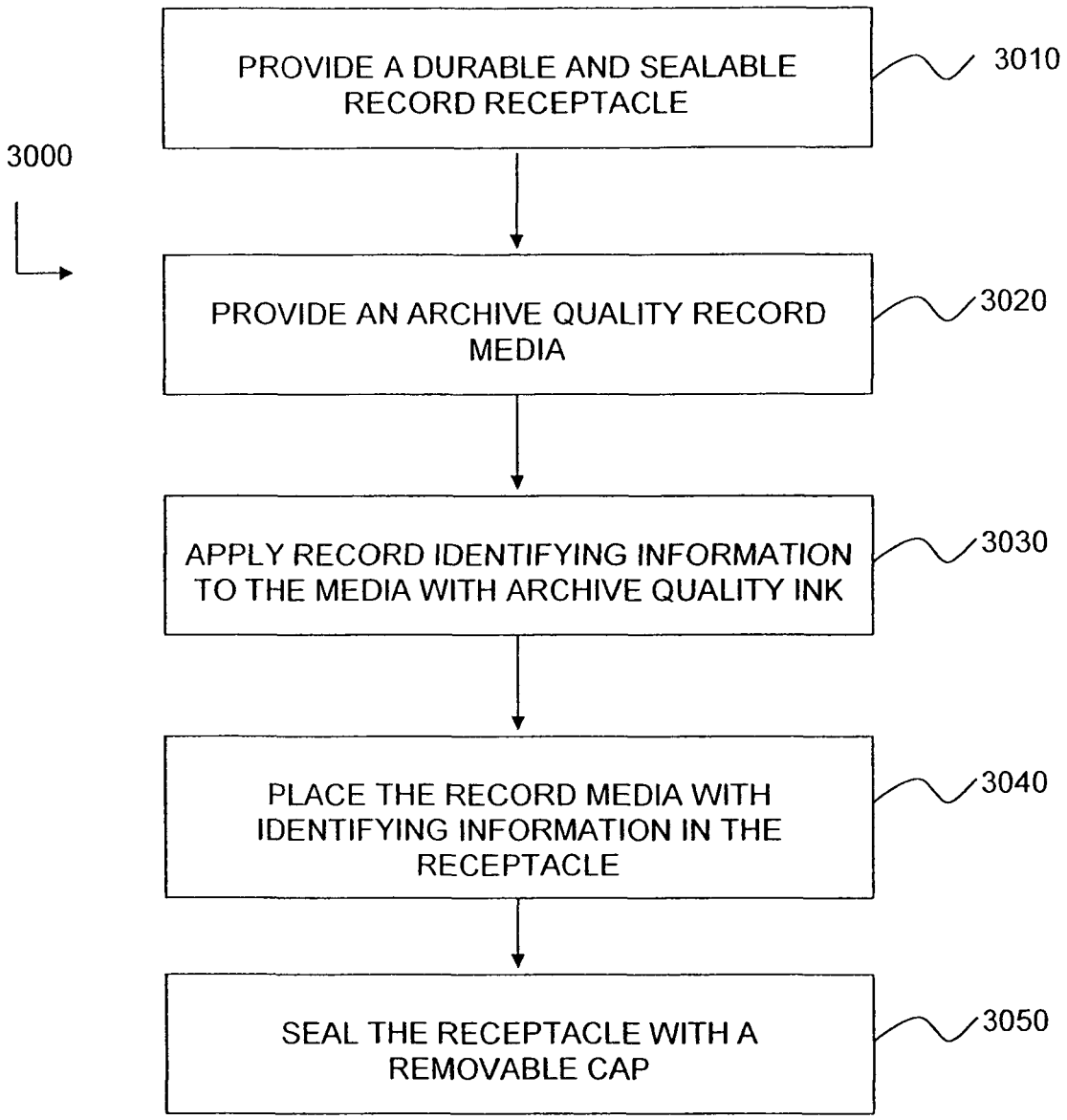
FIG. 29 is a flow chart of a way to provide archive quality records with a burial vault.

FIG. 29 is a flow chart 3000 showing an embodiment of the invention for providing records with a burial vault 100. A record receptacle is provided for a vault at 3010, for example, as described above in conjunction with FIGS. 1 through 7. An archive quality record media is provided at 3020 with the receptacle and is used to record identifying information at 3030 for the deceased and the location of the vault 100. The media is placed in the receptacle at 3040 and the receptacle is sealed at 3050.

Figure 30:
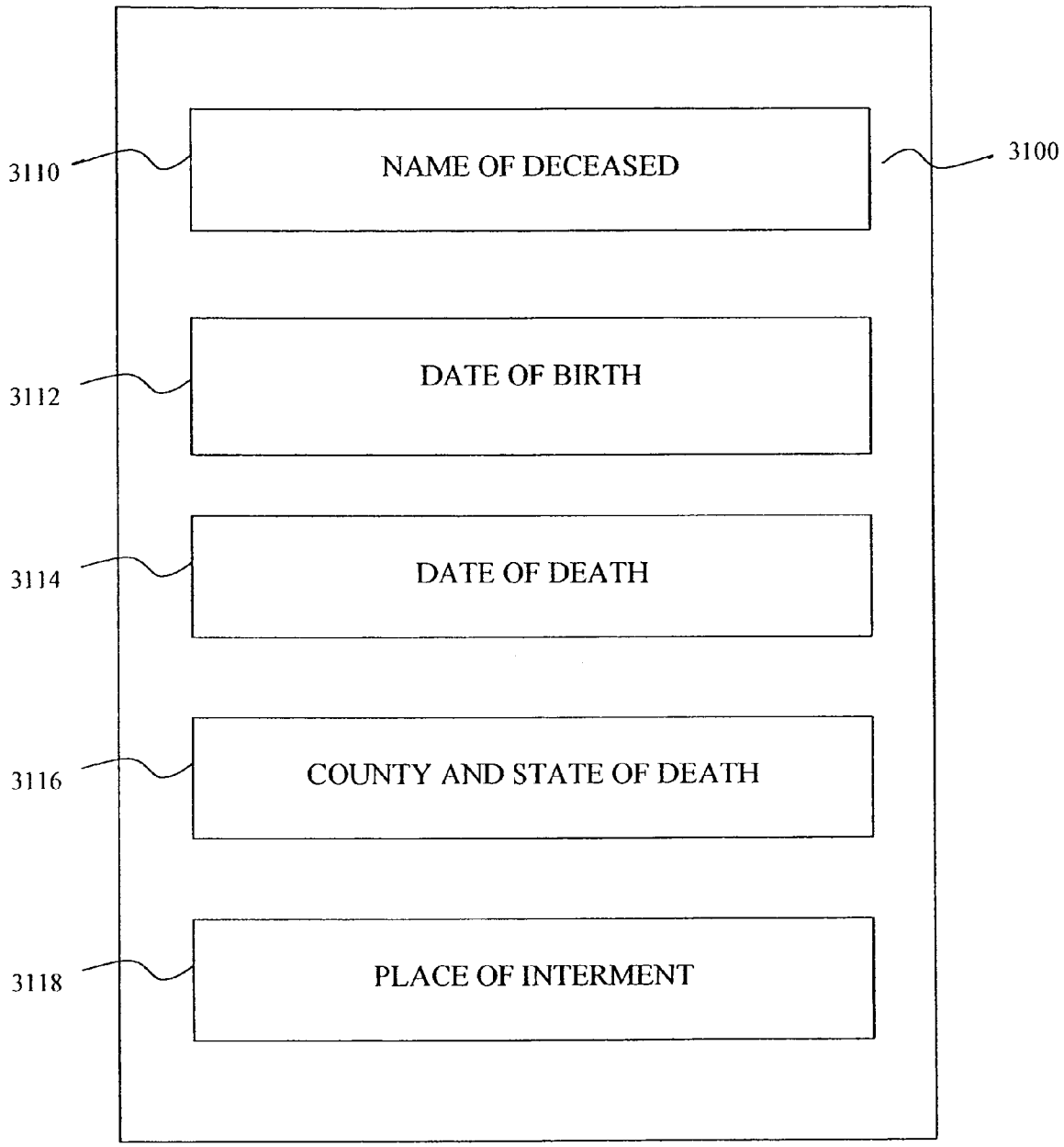
FIG. 30 shows exemplary record media with identifying information.

FIG. 30 illustrates categories of identifying information for the record media 3100. The record media 3100 contains various fields including several types of pertinent information. This information may contain any of, but is not limited to the following fields: name of the deceased 3110; date of birth 3112; date of death 3114; county and state of death 3116; and place of interment 3118. Alternatively, the record media 3100 shown in FIG. 31 contains, but is not limited to the following fields: Personal information such as the name of the deceased 3110; date of birth 3112; date of death 3114; and county and state of death 3116; cemetery information and place of interment 3118, county of interment 3210, cemetery lot information 3212, section # 3214, lot # 3216, row # 3218, and grave # 3220. The record media 3100 may also include funeral home information such as the name of the funeral home 3230, city 3232 and state 3234; Vault Manufacturing Company 3240, city 3242, and state 3244; and a cautionary statement regarding opening a vault 3250. The fields may be preprinted or recorded or written by hand in archive quality form.

One type of record media 3100 is a paper record scroll. The record scroll is made of known archival quality paper, for example paper that is made of pure woven cotton and is acid free, such as Crane Byron Weston Linen Ledger Paper, manufactured by Crane & Company, headquartered in Dalton, Mass. Information may be written on such paper with known acid-free, archival quality printing ink such as Higgins Ink, 4400 Series, manufactured by the Sanford Corporation, Headquartered in Bellwood, Ill. The acid free archival quality ink may be incorporated into a memorial record pen, such as Sanford Calligraphic Pens Permanent 4500 Series or Sanford Calligraphic Pens Permanent 4600 Series, manufactured by the Sanford Corporation, headquartered in Bellwood, Ill. The memorial record pen may be used to print any required information on the archival paper in a suitable script. The record scroll may be brought to the gravesite at the time of interment and sealed within the receptacle 140. This system can provide comfort to the family, funeral professional, and the cemetery responsible for the care of the deceased, because all will know that the identifying information is contained within the receptacle 140 and will be accessible and legible for many years.

At least one other scroll can be placed in the receptacle 140 to provide a personal message from the family, friends or other loved ones. FIG. 32 illustrates a personal message scroll 3260 that could be used to leave a personal message or provide information or trivia concerning the deceased. For example, a scroll could contain information regarding hobbies, interests, career, military service, or family members. Also, a picture or other personal items may be retained in the receptacle 140. A memorial record scroll 3200 with the aforementioned information of FIGS. 30 and 31 is also shown.

Alternative embodiments of record media for the receptacle are possible. The record media may be anything capable of storing and displaying information, including electronic media. For example, the record media could include a CD, a computer disc, any type of optical disc, electronic memory, audio and video tapes and other such media, holographic information, or even media containing DNA or bar codes. Additionally, the record receptacle 140 may be filled with an inert or non-reactive gas, for example nitrogen, or a vacuum may be applied to prevent deterioration of the sealed record media.

Once the required information is recorded, the record media are then placed within the receptacle. The receptacle is then sealed, preferably in a readily accessible manner.

While the invention has been described above by reference to various embodiments, it will be understood that many changes and modifications can be made without departing from the scope of the invention. It is therefore intended that the foregoing detailed description be understood as an illustration of the presently preferred embodiments of the invention, and not as a definition of the invention. It is only the following claims, including all equivalents, which are intended to define the scope of this invention.

I claim:

1. An apparatus for keeping records concerning a burial vault, the apparatus comprising:

an archival quality record receptacle embedded in a material of the vault, wherein the record receptacle includes at least one cap, wherein the record receptacle includes means for maintaining a fixed position within the material of the vault; and at least one archival quality record media containing information and sealed within said receptacle.

2. The apparatus of claim 1, wherein the material of the vault comprises concrete.

3. The apparatus of claim 1, wherein the record media includes information about a deceased being buried within the vault and a burial location of the vault.

4. The apparatus of claim 1, wherein the record receptacle and cap comprise a non-corrosive metal.

5. The apparatus of claim 1, wherein the record receptacle and cap comprise a plastic material.

6. The apparatus of claim 1, further comprising a seal between the record receptacle and the cap.

7. The apparatus of claim 6, wherein the seal comprises an O-ring.

8. The apparatus of claim 7, wherein the receptacle includes a groove and the groove accommodates the O-ring.

9. The apparatus of claim 1, further comprising a sealing means for creating a water-tight seal between the record receptacle and the cap.

10. The apparatus of claim 1, further including an adhesive bonding the record receptacle and the material of the vault.

11. The apparatus of claim 10, wherein the adhesive comprises an epoxy resin.

12. The apparatus of claim 1, wherein the record receptacle includes at least one groove for maintaining the position of the record receptacle within the material of the vault.

13. The apparatus of claim 1, wherein the record receptacle comprises a cylindrical shape.

14. An apparatus for keeping records concerning a burial vault, the apparatus comprising:

an archival quality record receptacle embedded in a material of the vault, wherein an exposed end of the record receptacle is recessed with respect to an exposed outer surface of the vault to protect the receptacle, and wherein the record receptacle includes at least one groove for maintaining the position of the record receptacle within the material of the vault; and at least one archival quality record media containing information and sealed within said receptacle.

15. The apparatus of claim 14, wherein the material of the vault comprises concrete.

16. The apparatus of claim 14, wherein the record media includes information about a deceased being buried within the vault and a burial location of the vault.

17. The apparatus of claim 14, wherein the record receptacle includes at least one cap and means for releasably sealing the cap.

18. The apparatus of claim 17, wherein the record receptacle and cap comprise a non-corrosive metal.

19. The apparatus of claim 17, wherein the record receptacle and cap comprise a plastic material.

20. The apparatus of claim 17, further comprising a seal between the record receptacle and the cap.

21. The apparatus of claim 20, wherein the seal comprises an O-ring.

22. The apparatus of claim 21, wherein the receptacle includes a groove and the groove accommodates the O-ring.

23. The apparatus of claim 17, further comprising a sealing means for creating a water-tight seal between the record receptacle and the cap.

24. The apparatus of claim 14, further including an adhesive bonding the record receptacle and the material of the vault.

25. The apparatus of claim 24, wherein the adhesive comprises an epoxy resin.

26. The apparatus of claim 14, wherein the record receptacle comprises a cylindrical shape.

* * * * *

UNITED STATES PATENT AND TRADEMARK OFFICE

CERTIFICATE OF CORRECTION

PATENT NO. : 7,131,237 B2
APPLICATION NO. : 10/633056
DATED : November 7, 2006
INVENTOR(S) : Michael S. Pazar It is certified that error appears in the above-identified patent and that said Letters Patent is hereby corrected as shown below:

On Title Page,

[*] Notice: Subject to any disclaimer, the term of this patent is extended or adjusted under 35 USC 154(b) by (136) days Delete the phrase "by 136 days" and insert -- by 134 days--

Signed and Sealed this

Second Day of January, 2007

JON W. DUDAS
*Director of the United States Patent and Trademark Office*